US011808496B2

(12) United States Patent
Miyawaki et al.

(10) Patent No.: US 11,808,496 B2
(45) Date of Patent: Nov. 7, 2023

(54) HEAT EXCHANGER AND AIR-CONDITIONING APPARATUS

(71) Applicant: Mitsubishi Electric Corporation, Tokyo (JP)

(72) Inventors: Kosuke Miyawaki, Tokyo (JP); Yoji Onaka, Tokyo (JP); Yohei Kato, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 406 days.

(21) Appl. No.: 17/263,906

(22) PCT Filed: Aug. 22, 2018

(86) PCT No.: PCT/JP2018/030941
§ 371 (c)(1),
(2) Date: Jan. 28, 2021

(87) PCT Pub. No.: WO2020/039513
PCT Pub. Date: Feb. 27, 2020

(65) Prior Publication Data

US 2021/0231351 A1 Jul. 29, 2021

(51) Int. Cl.
*F25B 39/00* (2006.01)
*F25B 41/42* (2021.01)
*F25B 39/02* (2006.01)

(52) U.S. Cl.
CPC ..... *F25B 39/00* (2013.01); *F25B 41/42* (2021.01); *F25B 39/028* (2013.01); *F25B 2339/02* (2013.01)

(58) Field of Classification Search
CPC ..... F25B 39/00; F25B 41/42; F25B 39/028; F25B 2339/02; F25B 13/00; F25B 39/02;
(Continued)

(56) References Cited

U.S. PATENT DOCUMENTS 6,804,975 B2 * 10/2004 Park ..... F25B 13/00 62/238.7
2014/0338874 A1 11/2014 Jindou et al.
(Continued)

FOREIGN PATENT DOCUMENTS

EP 3382316 A1 10/2018
JP 2013-130386 A 7/2013
(Continued)

OTHER PUBLICATIONS

Pdf is translation of foreign reference WO 2018173356 A1 (Year: 2017).*
(Continued)

*Primary Examiner* — Len Tran
*Assistant Examiner* — Kamran Tavakoldavani
(74) *Attorney, Agent, or Firm* — XSENSUS LLP

(57) ABSTRACT

A heat exchanger includes plural heat transfer tubes disposed with a specified spacing from each other in the up and down direction, and a distributor configured to distribute refrigerant to the heat transfer tubes. The distributor includes a body part, and plural flow-splitting parts, the body part including a first passage in which refrigerant flows upward, the flow-splitting parts communicating with the first passage and with one of the heat transfer tubes. The flow-splitting parts include one or more first flow-splitting parts each communicating with a first heat transfer tube, which is a higher positioned heat transfer tube. The flow-splitting parts include one or more second heat transfer tubes each communicating with a second heat transfer tube positioned below the first heat transfer tube. The refrigerant inlet of the first flow-splitting part communicates with the first passage at a location below the refrigerant inlet of the second flow-splitting part.

16 Claims, 29 Drawing Sheets

(58) Field of Classification Search
CPC ..... F28D 1/05325; F28D 1/05375; F28D 2021/0068; F24F 1/16; F28F 9/0221; F28F 9/0224; F28F 1/32
See application file for complete search history.

(56) References Cited

U.S. PATENT DOCUMENTS

| | | | | |
|---|---|---|---|---|
| 2015/0059392 | A1* | 3/2015 | Chi | F25B 31/004 237/69 |
| 2016/0033179 | A1* | 2/2016 | Kim | F25B 39/00 165/143 |
| 2017/0268790 | A1* | 9/2017 | Yokozeki | F28D 1/047 |

FOREIGN PATENT DOCUMENTS

| | | | |
|---|---|---|---|
| JP | 2017-155990 | A | 9/2017 |
| JP | 2017-211113 | A | 11/2017 |
| JP | 2018-44759 | A | 3/2018 |
| WO | WO-2018173356 | A1 * | 11/2017 |
| WO | WO-2018173356 | A1 * | 9/2018 |

OTHER PUBLICATIONS

Pdf is translation of foreign referecne WO-2018173356-A1 (Year: 2018).*
International Search Report and Written Opinion dated Oct. 23, 2018, received for PCT Application No. PCT/JP2018/030941, Filed on Aug. 22, 2018, 9 Pages including English Translation.

* cited by examiner

HEAT EXCHANGER AND AIR-CONDITIONING APPARATUS

CROSS-REFERENCE TO RELATED APPLICATION

The present application is based on PCT filing PCT/JP2018/030941, filed Aug. 22, 2018, the entire contents of which are incorporated herein by reference.

TECHNICAL FIELD

The present disclosure relates to a heat exchanger including a distributor to distribute two-phase gas-liquid refrigerant to plural heat transfer tubes, and an air-conditioning apparatus including the heat exchanger.

BACKGROUND ART

Air-conditioning apparatuses include, as one component of the refrigeration cycle circuit, a heat exchanger that functions as an evaporator. Two-phase gas-liquid refrigerant, which is a mixture of gas refrigerant and liquid refrigerant, flows into the evaporator. Some related-art heat exchangers that function as evaporators include plural heat transfer tubes. Further, some proposed related-art heat exchangers that function as evaporators and include plural heat transfer tubes include a distributor to distribute two-phase gas-liquid refrigerant to individual heat transfer tubes (see, for example, Patent Literature 1). Such related-art distributor includes a body part, and plural flow-splitting parts. The body part is formed as, for example, a tubular component. The body part includes an inlet for two-phase gas-liquid refrigerant, and a flow passage in which the two-phase gas-liquid refrigerant entering through the inlet flows upward. The flow-splitting parts are formed as, for example, tubular components, and disposed with a predetermined spacing from each other in the up and down direction. Each flow-splitting part provides communication between the passage within the body part, and one of the heat transfer tubes. That is, the flow of two-phase gas-liquid refrigerant entering the passage within the body part splits at the flow-splitting parts into separate streams before entering the individual heat transfer tubes.

CITATION LIST

Patent Literature

Patent Literature 1: Japanese Unexamined Patent Application Publication No. 2013-130386

SUMMARY OF INVENTION

Technical Problem

Two-phase gas-liquid refrigerant flowing upward in the passage within the body part is discharged sequentially from lower positioned flow-splitting parts. This results in reduced upward momentum of the two-phase gas-liquid refrigerant near higher positioned flow-splitting parts. Consequently, for example, under conditions of low refrigerant circulation rate within the refrigeration cycle circuit such as during low-capacity operation of the air-conditioning apparatus, if the upward momentum of two-phase gas-liquid refrigerant becomes less than or equal to a certain value, gravity hinders the upward flow of liquid refrigerant, which has a greater density than gas refrigerant. Liquid refrigerant is thus unable to reach higher positioned flow-splitting parts. This results in no liquid refrigerant being supplied to some of higher positioned heat transfer tubes, leading to degradation of the heat exchange performance of the evaporator.

One way to avoid the above-mentioned problem is to reduce the effective cross-sectional area of the passage within the body part to increase the upward momentum of the two-phase gas-liquid refrigerant. However, reducing the effective cross-sectional area of the passage within the body part has the following problem. For example, under conditions of high refrigerant circulation rate within the refrigeration cycle circuit such as during high-capacity operation of the air-conditioning apparatus, higher positioned heat transfer tubes receive excessive supply of liquid refrigerant. Another problem with reducing the effective cross-sectional area of the passage within the body part is that under conditions of high refrigerant circulation rate within the refrigeration cycle circuit, the pressure loss within the distributor increases. For this reason, reducing the effective cross-sectional area of the passage within the body part results in degradation of the heat exchange performance of the evaporator under conditions of high refrigerant circulation rate within the refrigeration cycle circuit. Therefore, reducing the effective cross-sectional area of the passage within the body part does not make it possible to maintain the heat exchange performance of the evaporator over wide operating conditions of the air-conditioning apparatus ranging from low-capacity operation to high-capacity operation. This leads to reduced energy-saving performance of the air-conditioning apparatus.

Another conceivable way to address the above problem, that is, degradation of the heat exchange performance of the evaporator under conditions of low refrigerant circulation rate within the refrigeration cycle circuit, is to split the passage within the body part into smaller portions by use of partition walls, as with the distributor disclosed in Patent Literature 1. Use of this approach, however, increases the number of components of the distributor, leading to increased material and machining costs of the distributor. This translates into increased manufacturing cost of the heat exchanger that functions as an evaporator.

The present disclosure has been made to address the above-mentioned problems, and accordingly a first object of the present disclosure is to provide a heat exchanger capable of, when functioning as an evaporator, maintaining its heat exchange performance over wide operating conditions of the air-conditioning apparatus ranging from low-capacity operation to high-capacity operation, and minimizing an increase in manufacturing cost. A second object of the present disclosure is to provide an air-conditioning apparatus including such a heat exchanger.

Solution to Problem

A heat exchanger according to an embodiment of the present disclosure includes plural heat transfer tubes, and a distributor. The heat transfer tubes are disposed with a predetermined spacing from each other in the up and down direction. The distributor is configured to distribute refrigerant to the heat transfer tubes. The distributor includes a body part, and plural flow-splitting parts. The body part includes a first inlet for refrigerant, and a first passage in which refrigerant entering through the first inlet flows upward. The flow-splitting parts each include a second passage, each flow-splitting part communicating at a second inlet with the first passage and communicating at an outlet with one of the heat transfer tubes. The second inlets of at least two of the flow-splitting parts each communicate with the first passage at a location above the first inlet. Among the heat transfer tubes each communicating with the outlet of the flow-splitting part whose second inlet communicates with the first passage at a location above the first inlet, at least the first one of the heat transfer tubes from the top is defined as a first heat transfer tube. Among the heat transfer tubes each communicating with the outlet of the flow-splitting part whose second inlet communicates with the first passage at a location above the first inlet, the heat transfer tube positioned below the first heat transfer tube is defined as a second heat transfer tube. The flow-splitting part whose outlet communicates with the first heat transfer tube is defined as a first flow-splitting part. The flow-splitting part whose outlet communicates with the second heat transfer tube is defined as a second flow-splitting part. The second inlet of the first flow-splitting part communicates with the first passage at a location below the second inlet of the second flow-splitting part that communicates with the first passage at the highest location.

Further, an air-conditioning apparatus according to an embodiment of the present disclosure includes the heat exchanger according to an embodiment of the present disclosure that functions as an evaporator, and a fan that supplies air to the heat exchanger.

Advantageous Effects of Invention

In the heat exchanger according to an embodiment of the present disclosure, the first heat transfer tube, which is a higher positioned heat transfer tube among the heat transfer tubes of the heat exchanger, communicates with the first passage of the body part at a location below a location where one or more second heat transfer tubes positioned below the first heat transfer tube communicate with the first passage. Consequently, when used as an evaporator, the heat exchanger according to an embodiment of the present disclosure makes it possible to prevent the first heat transfer tube, which is a higher positioned heat transfer tube, from receiving no supply of liquid refrigerant during low-capacity operation of the air-conditioning apparatus. Thus, using the heat exchanger according to an embodiment of the present disclosure as an evaporator makes it possible to maintain the heat exchange performance of the evaporator during low-capacity operation of the air-conditioning apparatus. In this regard, the heat exchanger according to an embodiment of the present disclosure makes it possible to maintain the heat exchange performance of the evaporator during low-capacity operation of the air-conditioning apparatus without reducing the effective cross-sectional area of the first passage. This means that using the heat exchanger according to an embodiment of the present disclosure makes it possible to maintain the heat exchange performance of the evaporator also during high-capacity operation of the air-conditioning apparatus. Further, the distributor of the heat exchanger according to an embodiment of the present disclosure allows the number of components to be reduced in comparison to a distributor having within its body a passage that is divided into smaller portions by use of partition walls. As a result, the heat exchanger according to an embodiment of the present disclosure allows for reduced manufacturing cost in comparison to a heat exchanger including a distributor having within its body a passage that is divided into smaller portions by use of partition walls. That is, the heat exchanger according to an embodiment of the present disclosure is capable of, when functioning as an evaporator, maintaining its heat exchange performance over wide operating conditions of the air-conditioning apparatus ranging from low-capacity operation to high-capacity operation, and minimizing an increase in manufacturing cost.

DESCRIPTION OF EMBODIMENTS

Figure 1:
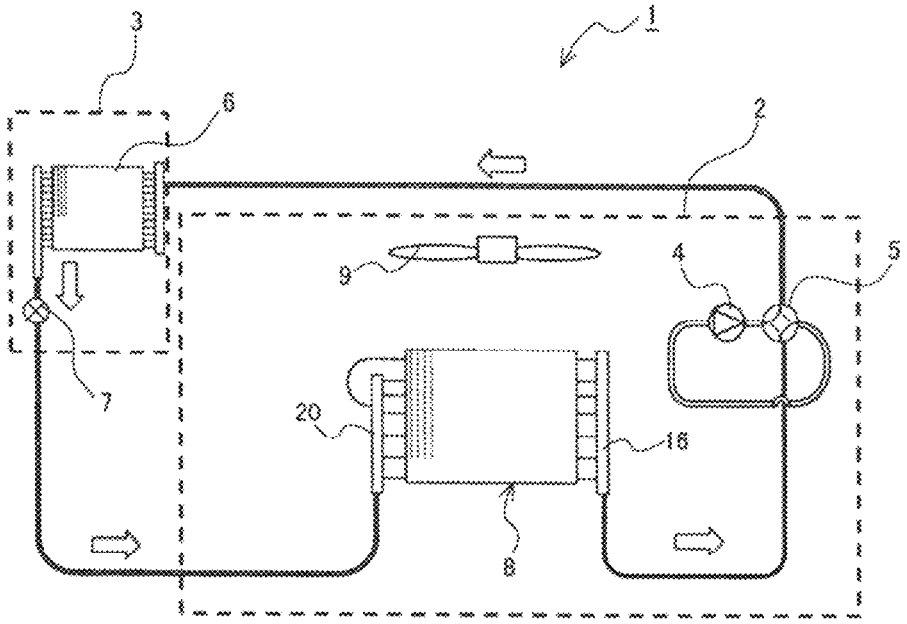
FIG. 1 is a diagram of an air-conditioning apparatus according to Embodiment 1 of the present disclosure.

A heat exchanger and an air-conditioning apparatus according to exemplary embodiments of the present disclosure will be described below with reference to the drawings. In the drawings below, features designated by the same reference signs represent the same or corresponding features. The specific arrangements of features described in the following embodiments are illustrative only. The heat exchanger and the air-conditioning apparatus according to the present disclosure are not limited to the specific features described in the following embodiments. Features to be combined with each other may not necessarily be features in the same embodiment but may be features described in different embodiments. In the drawings below, the relative sizes of various components may in some cases differ from those of the actual embodiment of the present disclosure.

Embodiment 1

FIG. 1 is a diagram of an air-conditioning apparatus according to Embodiment 1 of the present disclosure. The open arrows in FIG. 1 represent the direction in which refrigerant flows during heating operation. In other words, the open arrows in FIG. 1 represent how refrigerant flows when an outdoor heat exchanger 8 functions as an evaporator.

An air-conditioning apparatus 1 includes a compressor 4 that compresses refrigerant, an indoor heat exchanger 6 that functions as a condenser, an expansion device 7 that decompresses refrigerant to cause the refrigerant to expand, and the outdoor heat exchanger 8 that functions as an evaporator. The compressor 4, the indoor heat exchanger 6, the expansion device 7, and the outdoor heat exchanger 8 are sequentially connected by refrigerant pipes to form a refrigeration cycle circuit. In Embodiment 1, the indoor heat exchanger 6 also includes a four-way valve 5, which is used to switch the passages of refrigerant discharged from the compressor 4 to thereby make the indoor heat exchanger 6 function as an evaporator and make the outdoor heat exchanger 8 function as a condenser.

The compressor 4, the four-way valve 5, and the outdoor heat exchanger 8 are accommodated in an outdoor unit 2. The outdoor unit 2 also accommodates a fan 9 that supplies outdoor air to the outdoor heat exchanger 8. The indoor heat exchanger 6 and the expansion device 7 are accommodated in an indoor unit 3. The indoor unit 3 also accommodates a fan (not illustrated) that supplies indoor air, which is air in an air-conditioned space, to the indoor heat exchanger 6.

The configuration of the outdoor heat exchanger 8 is now described below in detail.

Figure 2:
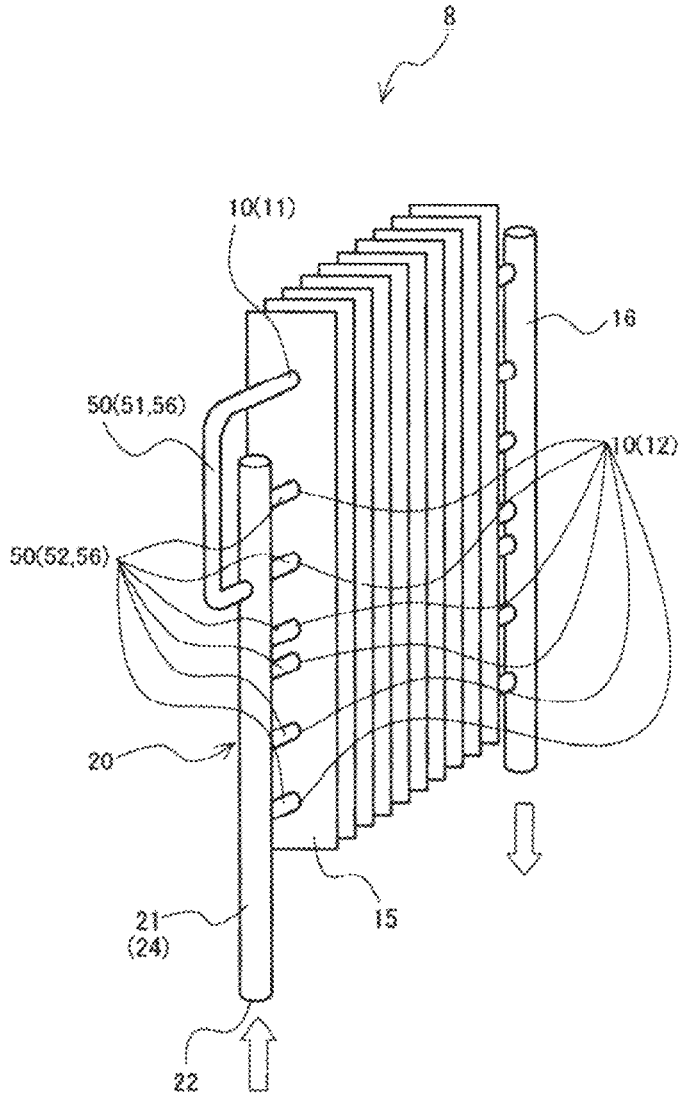
FIG. 2 is a perspective view of an outdoor heat exchanger according to Embodiment 1 of the present disclosure.
Figure 3:
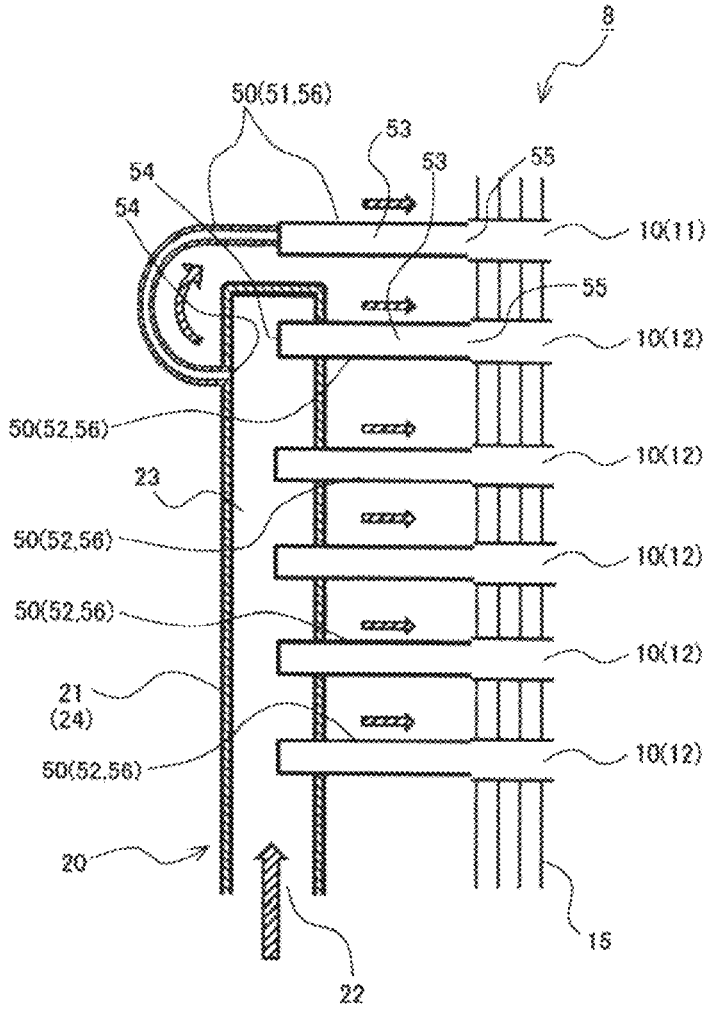
FIG. 3 is a longitudinal sectional view of an area in the vicinity of a distributor of the outdoor heat exchanger according to Embodiment 1 of the present disclosure.

FIG. 2 is a perspective view of an outdoor heat exchanger according to Embodiment 1 of the present disclosure. FIG. 3 is a longitudinal sectional view of an area in the vicinity of a distributor of the outdoor heat exchanger according to Embodiment 1 of the present disclosure. FIG. 3 is a longitudinal section taken parallel to the direction in which heat transfer tubes 10 extend. The open arrows in FIG. 2 and the hatched arrows in FIG. 3 each represent how refrigerant flows when the outdoor heat exchanger 8 functions as an evaporator.

The outdoor heat exchanger 8 includes the heat transfer tubes 10, and a distributor 20 that distributes refrigerant to the heat transfer tubes 10. The heat transfer tubes 10 each extend in the horizontal direction. The heat transfer tubes 10 are disposed with a predetermined spacing from each other in the up and down direction. When the outdoor heat exchanger 8 functions as an evaporator, refrigerant flowing in each heat transfer tube 10 is heated by outdoor air and evaporates. In Embodiment 1, plural heat transfer fins 15 are connected to the heat transfer tubes 10 to facilitate heat exchange between refrigerant and outdoor air.

The distributor 20 includes a body part 21, and plural flow-splitting parts 50. The body part 21 includes a first inlet 22, which is an inlet for refrigerant, and a first passage 23 in which refrigerant entering through the first inlet 22 flows upward. In Embodiment 1, refrigerant flows in the first passage 23 in the substantially vertical direction. The flow-splitting parts 50 are disposed with a predetermined spacing from each other in the up and down direction, such as the substantially vertical direction. Each flow-splitting part 50 includes a second passage 53. Each flow-splitting part 50 communicates with the first passage 23 of the body part 21 at a second inlet 54 through which refrigerant enters the second passage 53. Each flow-splitting part 50 communicates with one of the heat transfer tubes 10 at an outlet 55 through which refrigerant leaves the second passage 53. In Embodiment 1, each one flow-splitting part 50 communicates with the corresponding one heat transfer tube 10. An end portion of the heat transfer tube 10 may constitute at least a portion of the flow-splitting part 50. In other words, at least a portion of the flow-splitting part 50 may be formed integrally with the heat transfer tube 10. That is, the distributor 20 according to Embodiment 1 is a vertical-header distributor that distributes refrigerant flowing in the first passage 23, to the individual heat transfer tubes 10 from the flow-splitting parts 50 arranged in the vertical direction.

In Embodiment 1, the body part 21 is formed as a tubular component. The tubular component will hereinafter be referred to as first tubular component 24. The interior of the first tubular component 24 defines the first passage 23. The first tubular component 24 includes the first inlet 22 defined at the lower end. In Embodiment 1, each flow-splitting part 50 is formed as a tubular component. The tubular component will hereinafter be referred to as second tubular component 56. The interior of the second tubular component 56 defines the second passage 53. An end portion of the second tubular component 56 near the first passage 23 defines the second inlet 54, and an end portion of the second tubular component 56 near the heat transfer tube 10 defines the outlet 55.

The first inlet 22 may be provided at a location other than the lower end of the body part 21, such as the side of the body part 21. In this case, it may suffice that the second inlets 54 of at least two of the flow-splitting parts 50 communicate with the first passage 23 at a location above the first inlet 22.

In this regard, among the heat transfer tubes 10 each communicating with the outlet 55 of the flow-splitting part 50 whose second inlet 54 communicates with the first passage 23 at a location above the first inlet 22, at least the first one of the heat transfer tubes 10 from the top is defined as a first heat transfer tube 11. In FIGS. 2 and 3, the heat transfer tube 10 positioned first from the top serves as the first heat transfer tube 11. There may be plural first heat transfer tubes 11. Among the heat transfer tubes 10 each communicating with the outlet 55 of the flow-splitting part 50 whose second inlet 54 communicates with the first passage 23 at a location above the first inlet 22, the heat transfer tube 10 positioned below the first heat transfer tube 11 is defined as a second heat transfer tube 12. The flow-splitting part 50 whose outlet 55 communicates with the first heat transfer tube 11 is defined as a first flow-splitting part 51. The flow-splitting part 50 whose outlet 55 communicates with the second heat transfer tube 12 is defined as a second flow-splitting part 52.

With the first heat transfer tube 11, the second heat transfer tube 12, the first flow-splitting part 51, and the second flow-splitting part 52 defined as described above, the second inlet 54 of the first flow-splitting part 51 communicates with the first passage 23 at a location below the second inlet 54 of the second flow-splitting part 52 that communicates with the first passage 23 at the highest location. Each second flow-splitting part 52 is disposed such that the lower the location of the second flow-splitting part 52 communicating with the first passage 23, the lower the location of the second heat transfer tube 12 with which the second flow-splitting part 52 communicates. In this regard, the second inlet 54 of the first flow-splitting part 51 may communicate with the first passage 23 at a location below the second inlet 54 of the second flow-splitting part 52 that communicates with the first passage 23 at the second highest location or lower from the top.

With the distributor 20 configured as described above, when the outdoor heat exchanger 8 functions as an evaporator, two-phase gas-liquid refrigerant flows through the first inlet 22 into the first passage 23 of the body part 21. The two-phase gas-liquid refrigerant flows upward in the first passage 23. The two-phase gas-liquid refrigerant flowing upward in the first passage 23 passes into the individual flow-splitting parts 50 sequentially, first into lower positioned flow-splitting parts 50 connected to the first passage 23, and then into higher positioned flow-splitting parts 50 connected to the first passage 23. More specifically, the two-phase gas-liquid refrigerant flowing upward in the first passage 23 first passes into each second flow-splitting part 52 that communicates with the first passage 23 at a location below the second inlet 54 of the first flow-splitting part 51. In other words, the two-phase gas-liquid refrigerant flowing upward in the first passage 23 passes into individual heat transfer tubes sequentially, beginning with lower positioned second heat transfer tubes 12. Subsequently, the two-phase gas-liquid refrigerant flowing upward in the first passage 23 passes into the first flow-splitting part 51, and then into the first heat transfer tube 11. Thereafter, the two-phase gas-liquid refrigerant flowing upward in the first passage 23 passes into the second flow-splitting part 52 that communicates with the first passage 23 at a location above the second inlet 54 of the first flow-splitting part 51, and then into the second heat transfer tube 12 that communicates with the second flow-splitting part 52 mentioned above.

A flow-combining pipe 16 is connected to an end portion of each heat transfer tube 10 opposite to the end portion near the distributor 20. The streams of refrigerant leaving the individual heat transfer tubes 10 thus combine at the flow-combining pipe 16 before flowing out of the outdoor heat exchanger 8.

In FIG. 2, the flow-combining pipe 16 is depicted to be of a header type with a vertical passage defined therein. However, the flow-combining pipe 16 is not limited to this configuration. The flow-combining pipe 16 may be formed by, for example, using plural branch pipes to allow refrigerant streams leaving the individual heat transfer tubes 10 to combine. In one alternative configuration, the flow-combining pipe 16 may not necessarily be an indispensable component of the outdoor heat exchanger 8, and refrigerant streams leaving the individual heat transfer tubes 10 may be allowed to combine at a location outside the outdoor heat exchanger 8.

In FIG. 3, an end portion defining the second inlet 54 of the second tubular component 56 serving as the second flow-splitting part 52 is depicted as protruding into the first tubular component 24 from a side of the first tubular component 24. However, the end portion defining the second inlet 54 of the second tubular component 56 serving as the second flow-splitting part 52 may not necessarily be positioned as described above. The end portion defining the second inlet 54 of the second tubular component 56 serving as the second flow-splitting part 52 may not protrude into the first tubular component 24. In FIG. 3, an end portion defining the second inlet 54 of the second tubular component 56 serving as the first flow-splitting part 51 is depicted as not protruding into the first tubular component 24 from a side of the first tubular component 24. However, the end portion defining the second inlet 54 of the second tubular component 56 serving as the first flow-splitting part 51 may not necessarily be positioned as described above. The end portion defining the second inlet 54 of the second tubular component 56 serving as the first flow-splitting part 51 may protrude into the first tubular component 24.

Operation of the air-conditioning apparatus 1 is now described below.

Operation of the air-conditioning apparatus 1 during heating operation will be described first. High-temperature, high-pressure gas refrigerant compressed in the compressor 4 passes through the four-way valve 5 into the indoor heat exchanger 6 that functions as a condenser. Upon entering the indoor heat exchanger 6, the high-temperature, high-pressure gas refrigerant is cooled while supplying heat to indoor air, and turns into low-temperature liquid refrigerant, which then leaves the indoor heat exchanger 6. The liquid refrigerant leaving the indoor heat exchanger 6 is decompressed in the expansion device 7 into two-phase gas-liquid refrigerant at a low temperature and low pressure, which then flows into the distributor 20 of the outdoor heat exchanger 8 that functions as an evaporator. Upon entering the distributor 20 of the outdoor heat exchanger 8, the low-temperature, low-pressure two-phase gas-liquid refrigerant is distributed to the individual heat transfer tubes 10. The refrigerant flowing in the heat transfer tubes 10 evaporates upon being heated by outdoor air, and turns into low-pressure gas refrigerant before leaving the heat transfer tubes 10. Streams of low-pressure gas refrigerant leaving the individual heat transfer tubes 10 combine at the flow-combining pipe 16 before leaving the outdoor heat exchanger 8. The low-pressure gas refrigerant leaving the outdoor heat exchanger 8 passes through the four-way valve 5 before being sucked into the compressor 4, and is compressed again in the compressor 4 into high-temperature, high-pressure gas refrigerant.

Next, an explanation is made on how the air-conditioning apparatus 1 operates during cooling operation. High-temperature, high-pressure gas refrigerant compressed in the compressor 4 passes through the four-way valve 5 into the flow-combining pipe 16 of the outdoor heat exchanger 8 that functions as a condenser. Upon entering the flow-combining pipe 16 of the outdoor heat exchanger 8, the high-temperature, high-pressure gas refrigerant is distributed to the individual heat transfer tubes 10. The refrigerant flowing in the heat transfer tubes 10 condenses upon being cooled by outdoor air, and turns into low-temperature liquid refrigerant before leaving the heat transfer tubes 10. Streams of low-temperature liquid refrigerant leaving the individual heat transfer tubes 10 combine at the distributor 20 before leaving the outdoor heat exchanger 8. The liquid refrigerant leaving the outdoor heat exchanger 8 is decompressed in the expansion device 7 into two-phase gas-liquid refrigerant at a low temperature and low pressure, which then flows into the indoor heat exchanger 6 that functions as an evaporator. Upon entering the indoor heat exchanger 6, the low-temperature, low-pressure two-phase gas-liquid refrigerant evaporates while absorbing heat from indoor air, and turns into low-pressure gas refrigerant before leaving the indoor heat exchanger 6. The low-pressure gas refrigerant leaving the indoor heat exchanger 6 passes through the four-way valve 5 before being sucked into the compressor 4, and is compressed again in the compressor 4 into high-temperature, high-pressure gas refrigerant.

An explanation will be made on advantageous effects of the distributor 20 of the outdoor heat exchanger 8 according to Embodiment 1. First, with reference to FIG. 4, a description will be made of a distributor 220 according to related art, which is to be compared with the distributor 20 according to Embodiment 1.

Figure 4:
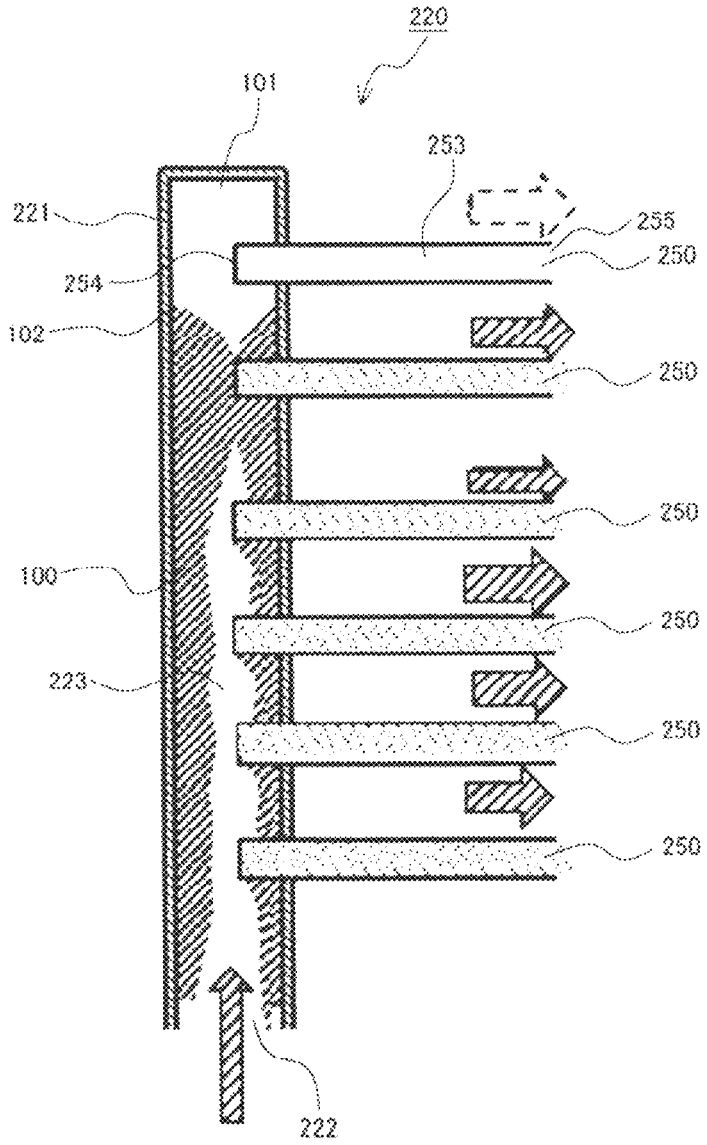
FIG. 4 is a longitudinal sectional view of a distributor according to related art.

FIG. 4 is a longitudinal sectional view of a distributor according to related art.

The distributor 220 according to related art includes a body part 221, and plural flow-splitting parts 250. The body part 221, which is a tubular component, includes an inlet 222 for refrigerant provided at the lower end. The body part 221 also includes a passage 223 in which refrigerant entering through the inlet 222 flows in, for example, an upward direction such as the vertical direction. The flow-splitting parts 250, which are tubular components, are disposed with a predetermined spacing from each other in the up and down direction, such as the substantially vertical direction. Each flow-splitting part 250 includes a passage 253. Each flow-splitting part 250 communicates with the passage 223 of the body part 221 at an inlet 254 through which refrigerant enters the passage 253. Each flow-splitting part 250 communicates with one of the heat transfer tubes at an outlet 255 through which refrigerant leaves the passage 253.

Each flow-splitting part 250 is disposed such that the lower the location of the flow-splitting part 250 communicating with the passage 223 of the body part 221, the lower the location of the heat transfer tube with which the flow-splitting part 250 communicates. Consequently, two-phase gas-liquid refrigerant flowing upward in the passage 223 of the body part 221 passes into the individual flow-splitting parts 250 sequentially, first into lower positioned flow-splitting parts 250 connected to the passage 223 of the body part 221, and then into higher positioned flow-splitting parts 250 connected to the passage 223 of the body part 221. That is, the two-phase gas-liquid refrigerant flowing upward in the passage 223 of the body part 221 passes into individual heat transfer tubes sequentially, first into lower positioned heat transfer tubes and then into higher positioned heat transfer tubes.

Consequently, the upward momentum of the two-phase gas-liquid refrigerant flowing upward in the passage 223 of the body part 221 decreases as the refrigerant travels upward. In this regard, the two-phase gas-liquid refrigerant is a mixture of liquid refrigerant 100 and gas refrigerant 101. A liquid reach height 102, which is the height that the liquid refrigerant 100 traveling upward in the passage 223 of the body part 221 reaches, has a positive correlation with the upward momentum of the two-phase gas-liquid refrigerant. When the upward momentum of the two-phase gas-liquid refrigerant becomes less than or equal to a certain value, gravity hinders the upward movement of the liquid refrigerant 100, which has a greater density than the gas refrigerant 101. Consequently, under conditions of low refrigerant circulation rate within the refrigeration cycle circuit such as during low-capacity operation of the air-conditioning apparatus, the liquid reach height 102 may in some cases be lower than the inlets 254 of higher positioned flow-splitting parts 250. In such a state, only the gas refrigerant 101 flows into higher positioned heat transfer tubes. The gas refrigerant 101 contributes very little to heat exchange in the evaporator in comparison to the liquid refrigerant 100. Thus, with the distributor 220 according to related art, a situation may arise in which, under conditions of low refrigerant circulation rate within the refrigeration cycle circuit such as during low-capacity operation of the air-conditioning apparatus, some heat transfer tubes receive only the gas refrigerant 101 as described above, which leads to degradation of the heat exchange performance of the evaporator.

Figure 5:
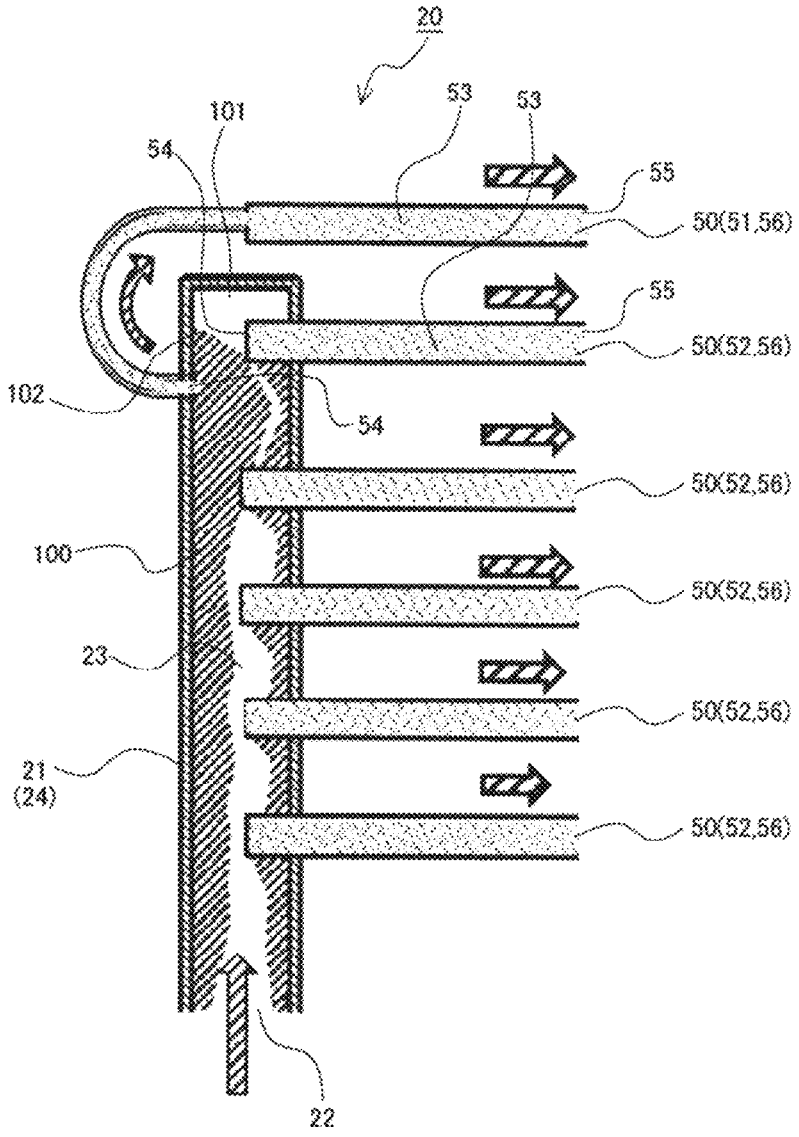
FIG. 5 is a longitudinal sectional view of the distributor of the outdoor heat exchanger according to Embodiment 1 of the present disclosure.

FIG. 5 is a longitudinal sectional view of the distributor of the outdoor heat exchanger according to Embodiment 1 of the present disclosure.

As described above, with the outdoor heat exchanger 8 according to Embodiment 1, the first heat transfer tube 11, which is a higher positioned heat transfer tube among the heat transfer tubes 10, communicates with the first flow-splitting part 51 of the distributor 20. In other words, the first heat transfer tube 11, which tends to receive only the gas refrigerant 101 under conditions of low refrigerant circulation rate within the refrigeration cycle circuit such as during low-capacity operation of the air-conditioning apparatus 1, communicates with the first flow-splitting part 51 of the distributor 20. Further, the second inlet 54 of the first flow-splitting part 51 communicates with the first passage 23 at a location below the second inlet 54 of the second flow-splitting part 52 that communicates with the first passage 23 at the highest location. Thus, with the distributor 20 according to Embodiment 1, the second inlet 54 of the first flow-splitting part 51 can be made to communicate with the first passage 23 at a location lower than the liquid reach height 102. This makes it possible for the distributor 20 according to Embodiment 1 to supply two-phase gas-liquid refrigerant to the first heat transfer tube 11, which, in the past, would otherwise receive only the gas refrigerant 101. Therefore, the distributor 20 according to Embodiment 1 makes it possible to, under conditions of low refrigerant circulation rate within the refrigeration cycle circuit such as during low-capacity operation of the air-conditioning apparatus 1, reduce degradation of the heat exchange performance of the outdoor heat exchanger 8 that functions as an evaporator.

Figure 6:
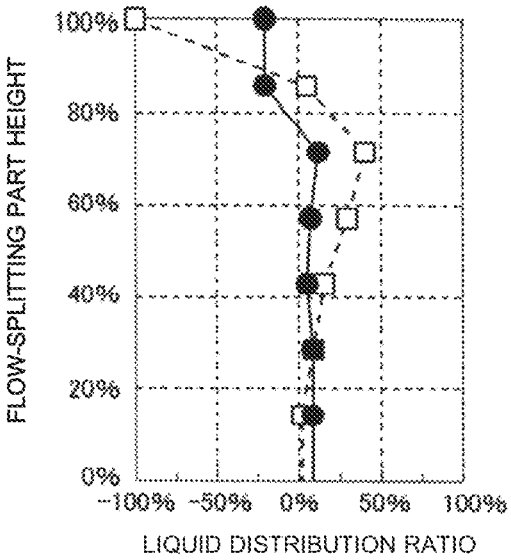
FIG. 6 illustrates the results of measurement of improvement in the distribution of liquid refrigerant in the distributor of the outdoor heat exchanger according to Embodiment 1 of the present disclosure.

FIG. 6 illustrates the results of measurement of improvement in the distribution of liquid refrigerant in the distributor of the outdoor heat exchanger according to Embodiment 1 of the present disclosure. The filled circles in FIG. 6 represent the results of measurement for the distributor 20 according to Embodiment 1. The open squares in FIG. 6 represent the results of measurement for the distributor 220 according to related art illustrated in FIG. 4. More specifically, the open squares in FIG. 6 represent the results of measurements for the air-conditioning apparatus 1 according to Embodiment 1 when the distributor 20 is replaced by the distributor 220 according to related art.

The liquid distribution ratio taken along the horizontal axis of FIG. 6 represents to what extent liquid refrigerant is distributed to each individual flow-splitting part. The liquid distribution ratio is defined as the equation below.

(liquid distribution ratio)=[{(the flow rate of liquid refrigerant through the flow-splitting part of interest)×(the number of flow-splitting parts)/(the flow rate of liquid refrigerant into the body part)}−1]×100

That is, if liquid refrigerant is distributed evenly to each individual flow-splitting part, the liquid distribution ratio for each flow-splitting part is 0%. For each flow-splitting part, a larger liquid distribution ratio indicates a higher flow rate of liquid refrigerant, and a smaller liquid distribution ratio indicates a lower flow rate of liquid refrigerant. A liquid distribution ratio of −100% indicates that no liquid refrigerant is distributed to the flow-splitting part.

The flow-splitting part height taken along the vertical axis of FIG. 6 represents the height of the refrigerant outlet of the flow-splitting part. In other words, the flow-splitting part height taken along the vertical axis of FIG. 6 represents the height of a heat transfer tube with which the corresponding flow-splitting part communicates. The flow-splitting part height is defined as the equation below.

(flow-splitting part height)={(the height of the refrigerant outlet of the flow-splitting part of interest)/(the height of the refrigerant outlet of the flow-splitting part whose refrigerant outlet is positioned highest)}×100

That is, for each flow-splitting part, the greater the value of flow-splitting part height, the higher the location of the refrigerant outlet, in other words, the higher the location of the heat transfer tube with which the flow-splitting part communicates.

As is shown in FIG. 6, with the distributor 220 according to related art, no liquid refrigerant is distributed to the flow-splitting part 250 whose outlet 255 for refrigerant is positioned highest. That is, with the distributor 220 according to related art, no liquid refrigerant is distributed to the highest positioned heat transfer tube. By contrast, as illustrated in FIG. 6, with the distributor 20 according to Embodiment 1, liquid refrigerant is distributed to all of the flow-splitting parts 50. In other words, the distributor 20 according to Embodiment 1 allows liquid refrigerant to be distributed to all of the heat transfer tubes 10.

Figure 7:
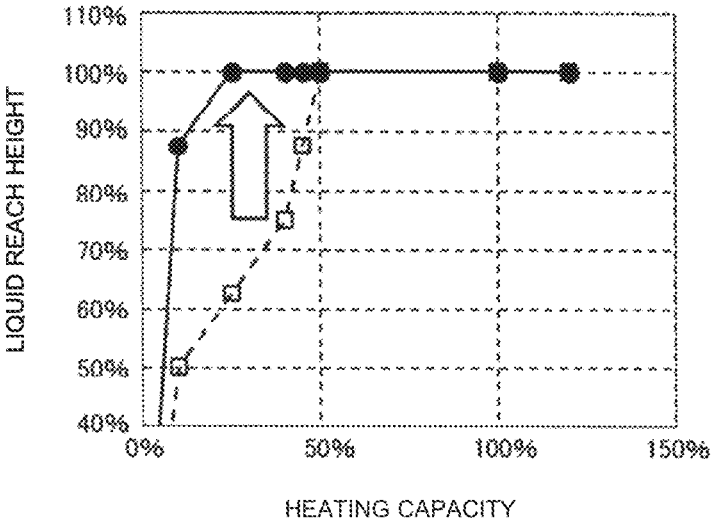
FIG. 7 illustrates, for the distributor of the outdoor heat exchanger according to Embodiment 1 of the present disclosure, the results of measurement of the relationship between the heating capacity of the air-conditioning apparatus and the height that liquid refrigerant reaches within the body part of the distributor.

FIG. 7 illustrates, for the distributor of the outdoor heat exchanger according to Embodiment 1 of the present disclosure, the results of measurement of the relationship between the heating capacity of the air-conditioning apparatus and the height that liquid refrigerant reaches within the body part of the distributor. The filled circles in FIG. 7 represent the results of measurement for the distributor 20 according to Embodiment 1. The open squares in FIG. 7 represent the results of measurement for the distributor 220 according to related art illustrated in FIG. 4. More specifically, the open squares in FIG. 7 represent the results of measurements for the air-conditioning apparatus 1 according to Embodiment 1 when the distributor 20 is replaced by the distributor 220 according to related art.

The heating capacity taken along the horizontal axis of FIG. 7 is defined as the equation below.

(heating capacity)={(the heating capacity of the air-conditioning apparatus 1 at the time of measurement)/(the maximum specified heating capacity of the air-conditioning apparatus 1}×100

The liquid reach height taken along the vertical axis of FIG. 7 is defined as the equation below.

(liquid reach height)={(the height of the refrigerant inlet of the flow-splitting part that liquid refrigerant has reached during measurement)/(the height of the refrigerant inlet of the flow-splitting part whose refrigerant inlet is positioned highest)}×100

As is observed in FIG. 7, with the distributor 220 according to related art, when the air-conditioning apparatus 1 has a heating capacity of less than 50%, liquid refrigerant fails to reach the inlet 254 of the highest positioned flow-splitting part 250. That is, the distributor 220 fails to supply liquid refrigerant to the highest positioned flow-splitting part 250, and thus fails to supply liquid refrigerant to the heat transfer tube communicating with the highest positioned flow-splitting part 250. By contrast, as is shown in FIG. 7, at a heating capacity of 25% or more, the distributor 20 according to Embodiment 1 allows liquid refrigerant to reach the second inlets 54 of all of the flow-splitting parts 50. That is, with the distributor 20 according to Embodiment 1, at a heating capacity of 25% or more, liquid refrigerant can be supplied to all of the flow-splitting parts 50, and hence liquid refrigerant can be supplied to all of the heat transfer tubes 10. In other words, the distributor 20 according to Embodiment 1 allows for improved distribution of liquid refrigerant to the heat transfer tubes 10 when the air-conditioning apparatus 1 has a heating capacity of less than 50%.

Figure 8:
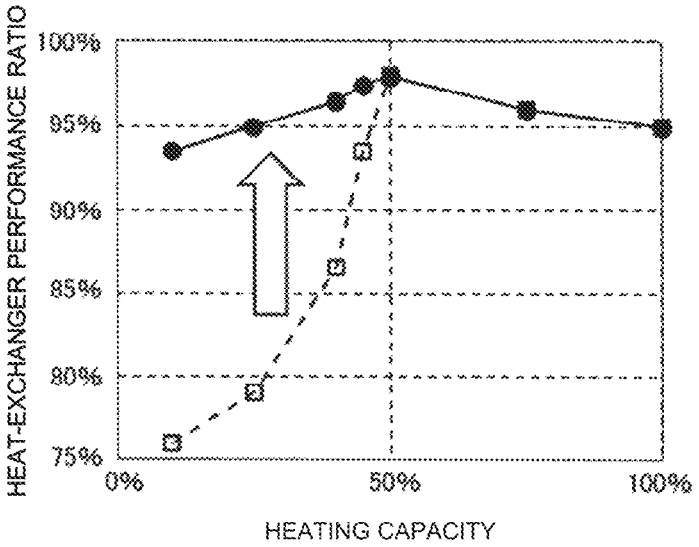
FIG. 8 illustrates, for the distributor of the outdoor heat exchanger according to Embodiment 1 of the present disclosure, the results of measurement of the relationship between the heating capacity of the air-conditioning apparatus and the heat exchange performance of the outdoor heat exchanger.

FIG. 8 illustrates, for the distributor of the outdoor heat exchanger according to Embodiment 1 of the present disclosure, the results of measurement of the relationship between the heating capacity of the air-conditioning apparatus and the heat exchange performance of the outdoor heat exchanger. The filled circles in FIG. 8 represent the results of measurement for the distributor 20 according to Embodiment 1. The open squares in FIG. 8 represent the results of measurement for the distributor 220 according to related art illustrated in FIG. 4. More specifically, the open squares in FIG. 8 represent the results of measurements for the air-conditioning apparatus 1 according to Embodiment 1 when the distributor 20 is replaced by the distributor 220 according to related art.

The heat exchange performance ratio taken along the vertical axis of FIG. 8 is defined as the equation below.

(heat exchange performance ratio)={(the amount of heat exchange per unit time in the outdoor heat exchanger at the time of measurement)/(the amount of heat exchange per unit time in the outdoor heat exchanger when two-phase gas-liquid refrigerant with the same gas-to-liquid ratio is introduced to all of the heat transfer tubes to provide uniform heat exchange over the entire area where the heat transfer fins of the outdoor heat exchanger are disposed)}×100

That is, the closer the heat exchange performance is to 100%, the closer the heat exchange performance of the outdoor heat exchanger is to an ideal value.

The heating capacity taken along the horizontal axis of FIG. 8 has the same definition as the heating capacity taken along the horizontal axis of FIG. 7.

As illustrated in FIG. 8, with the distributor 220 according to related art, significant degradation of the heat exchange performance ratio is observed for regions where the heating capacity of the air-conditioning apparatus 1 is less than 50%. That is, with the distributor 220 according to related art, the heat exchange performance of the outdoor heat exchanger degrades significantly for regions where the heating capacity of the air-conditioning apparatus 1 is less than 50%. By contrast, as illustrated in FIG. 8, in comparison to the distributor 220 according to related art, the distributor 20 according to Embodiment 1 allows for reduced degradation of the heat exchange performance ratio for regions where the heating capacity of the air-conditioning apparatus 1 is less than 50%. That is, in comparison to the distributor 220 according to related art, the distributor 20 according to Embodiment 1 makes it possible to reduce degradation of the heat exchange performance of the outdoor heat exchanger 8 for regions where the heating capacity of the air-conditioning apparatus 1 is less than 50%.

Further, the distributor 20 according to Embodiment 1 also makes it possible to reduce degradation of the heat exchange performance of the outdoor heat exchanger 8 for regions where the heating capacity of the air-conditioning apparatus 1 is greater than or equal to 50%. More specifically, with the distributor 20 according to Embodiment 1, degradation of the heat exchange performance ratio is less than or equal to 3% for regions where the heating capacity of the air-conditioning apparatus 1 is greater than or equal to 50%. In FIG. 8, the heat exchange performance ratio is at a local maximum when the heating capacity is 50%. However, the relationship between heating capacity and the local maximum of the heat exchange performance ratio depicted in FIG. 8 is only illustrative. The heating capacity at which the heat exchange performance ratio has a local maximum varies with various factors, including the effective cross-sectional area of the first passage 23 within the body part 21 of the distributor 20, the protrusion length of the flow-splitting part 50 into the body part 21, and the ratio between the number of first flow-splitting parts 51 and the number of second flow-splitting parts 52.

As described above with reference to FIG. 3, an end portion defining the second inlet 54 of the second tubular component 56 serving as the second flow-splitting part 52 protrudes into the first tubular component 24 from a side of the first tubular component 24. In this case, preferably, an end portion defining the second inlet 54 of the second tubular component 56 serving as the first flow-splitting part 51 does not protrude into the first tubular component 24 from a side of the first tubular component 24. If, as with the second flow-splitting part, an end portion defining the second inlet 54 of the second tubular component 56 serving as the first flow-splitting part 51 protrudes into the first tubular component 24 from a side of the first tubular component 24, the end portion defining the second inlet 54 of the second tubular component 56 serving as the first flow-splitting part 51 preferably protrudes into the first tubular component 24 by a length shorter than the length by which the end portion defining the second inlet 54 of the second tubular component 56 serving as the second flow-splitting part 52 protrudes into the first tubular component 24. When two-phase gas-liquid refrigerant flows upward in the first passage 23, a large amount of liquid refrigerant flow tends to distribute near the inner wall of the first passage 23. Therefore, if the end portion defining the second inlet 54 of the second tubular component 56 serving as the first flow-splitting part 51 is positioned as described above, more liquid refrigerant can be supplied to the first flow-splitting part 51, and hence more liquid refrigerant can be supplied to the first heat transfer tube 11.

As is apparent from FIGS. 2 and 3, as viewed in section taken perpendicular to the direction of flow of two-phase gas-liquid refrigerant in the first passage 23 of the body part 21, the direction of flow of two-phase gas-liquid refrigerant entering the second inlet 54 of the first flow-splitting part 51 preferably differs from the direction of flow of two-phase gas-liquid refrigerant entering the second inlet 54 of the second flow-splitting part 52. This configuration helps to ensure that, as viewed in section taken perpendicular to the direction of flow of two-phase gas-liquid refrigerant in the first passage 23 of the body part 21, a portion of the liquid refrigerant flowing near the inner wall of the first passage 23 can be readily directed into the second inlet 54 of the first flow-splitting part 51, the portion being a portion of the above-mentioned liquid refrigerant that flows in an area where no liquid refrigerant passes into the second inlet 54 of the second flow-splitting part 52. This allows more liquid refrigerant to be supplied to the first flow-splitting part 51, thus allowing more liquid refrigerant to be supplied to the first heat transfer tube 11. Further, the above-mentioned configuration helps to ensure that, if an end portion defining the second inlet 54 of the second tubular component 56 serving as the second flow-splitting part 52 protrudes into the first tubular component 24 from a side of the first tubular component 24, then as viewed in section taken perpendicular to the direction of flow of two-phase gas-liquid refrigerant in the first passage 23 of the body part 21, the end portion defining the second inlet 54 of the second tubular component 56 serving as the second flow-splitting part 52, and the second inlet 54 of the first flow-splitting part 51 do not overlap. Consequently, the liquid refrigerant to be directed into the second inlet 54 of the first flow-splitting part 51 is able to travel upward near the inner wall of the first passage 23, without being affected by the end portion defining the second inlet 54 of the second tubular component 56 serving as the second flow-splitting part 52. This allows more liquid refrigerant to be supplied to the first flow-splitting part 51, thus allowing more liquid refrigerant to be supplied to the first heat transfer tube 11.

As described above, the outdoor heat exchanger 8 according to Embodiment 1 includes the heat transfer tubes 10 disposed with a predetermined spacing from each other in the up and down direction, and the distributor 20 that distributes refrigerant to the heat transfer tubes 10. The distributor 20 includes the body part 21, and the flow-splitting parts 50. The body part 21 includes the first inlet 22 for refrigerant, and the first passage 23 in which refrigerant entering through the first inlet 22 flows upward. Each flow-splitting part 50 includes the second passage 53. Each flow-splitting part 50 communicates with the first passage 23 of the body part 21 at the second inlet 54 through which refrigerant enters the second passage 53. Each flow-splitting part 50 communicates with one of the heat transfer tubes 10 at the outlet 55 through which refrigerant leaves the second passage 53. The second inlets 54 of at least two of the flow-splitting parts 50 each communicate with the first passage 23 at a location above the first inlet 22. Among the heat transfer tubes 10 each communicating with the outlet 55 of the flow-splitting part 50 whose second inlet 54 communicates with the first passage 23 at a location above the first inlet 22, at least the first one of the heat transfer tubes 10 from the top is defined as the first heat transfer tube 11. Among the heat transfer tubes 10 each communicating with the outlet 55 of the flow-splitting part 50 whose second inlet 54 communicates with the first passage 23 at a location above the first inlet 22, the heat transfer tube 10 positioned below the first heat transfer tube 11 is defined as the second heat transfer tube 12. The flow-splitting part 50 whose outlet 55 communicates with the first heat transfer tube 11 is defined as the first flow-splitting part 51. The flow-splitting part 50 whose outlet 55 communicates with the second heat transfer tube 12 is defined as the second flow-splitting part 52. With these components defined as mentioned above, the second inlet 54 of the first flow-splitting part 51 communicates with the first passage 23 at a location below the second inlet 54 of the second flow-splitting part 52 that communicates with the first passage 23 at the highest location.

In the outdoor heat exchanger 8 according to Embodiment 1, the first heat transfer tube 11, which is a higher positioned heat transfer tube among the heat transfer tubes 10, communicates with the first passage 23 of the body part 21 at a location below a location where one or more second heat transfer tubes 12 positioned below the first heat transfer tube 11 communicate with the first passage 23. Consequently, when used as an evaporator, the outdoor heat exchanger 8 according to Embodiment 1 makes it possible to prevent the first heat transfer tube 11, which is a higher positioned heat transfer tube, from receiving no supply of liquid refrigerant during low-capacity operation of the air-conditioning apparatus 1. Thus, using the outdoor heat exchanger 8 according to Embodiment 1 as an evaporator makes it possible to maintain the heat exchange performance of the evaporator during low-capacity operation of the air-conditioning apparatus 1. In this regard, the outdoor heat exchanger 8 according to Embodiment 1 makes it possible to maintain the heat exchange performance of the evaporator during low-capacity operation of the air-conditioning apparatus 1 without reducing the effective cross-sectional area of the first passage 23. This means that using the outdoor heat exchanger 8 according to Embodiment 1 makes it possible to maintain the heat exchange performance of the evaporator also during high-capacity operation of the air-conditioning apparatus 1. Further, the distributor 20 of the outdoor heat exchanger 8 according to Embodiment 1 allows the number of components to be reduced in comparison to a distributor having within its body a passage that is divided into smaller portions by use of partition walls. As a result, the outdoor heat exchanger 8 according to Embodiment 1 allows for reduced manufacturing cost in comparison to a heat exchanger including a distributor having within its body a passage that is divided into smaller portions by use of partition walls. That is, the outdoor heat exchanger 8 according to Embodiment 1 is capable of, when functioning as an evaporator, maintaining its heat exchange performance over wide operating conditions of the air-conditioning apparatus 1 ranging from low-capacity operation to high-capacity operation, and minimizing an increase in manufacturing cost.

The air-conditioning apparatus 1 described above is only representative of one example of the air-conditioning apparatus 1 according to Embodiment 1. The foregoing description is not intended to restrict, for example, the location of the fan 9 in the outdoor unit 2 of the air-conditioning apparatus 1. The outdoor unit 2 may be of a top-flow type with airflow exiting through the top of its housing, or may be of a side-flow type with airflow exiting through the side of its housing.

In one alternative example, the air-conditioning apparatus 1 may not necessarily include only one outdoor unit 2 but may include plural indoor units 3. In another alternative example, the air-conditioning apparatus 1 may not necessarily include only one indoor heat exchanger 6, either, but may include plural indoor heat exchangers 6. In this case, each of refrigerant pipes connecting the individual indoor heat exchangers 6 with the distributor 20 of the outdoor heat exchanger 8 may be provided with the expansion device 7. In one alternative example, if the air-conditioning apparatus 1 includes plural indoor units 3, the expansion device 7 accommodated in each indoor unit 3, and the distributor 20 of the outdoor heat exchanger 8 may be connected with each other via a flow-splitting controller or other such device that adjusts how much refrigerant is to be supplied to the indoor unit 3. In another alternative example, a gas-liquid separator may be disposed between the expansion device 7, and the distributor 20 of the outdoor heat exchanger 8. The kind of refrigerant to be circulated in the refrigeration cycle circuit of the air-conditioning apparatus 1 is not particularly limited.

The heat transfer tubes 10 of the outdoor heat exchanger 8 are not limited to cylindrical heat transfer tubes but various heat transfer tubes may be used as the heat transfer tubes 10, including flat heat transfer tubes each including plural passages defined therein.

Figure 9:
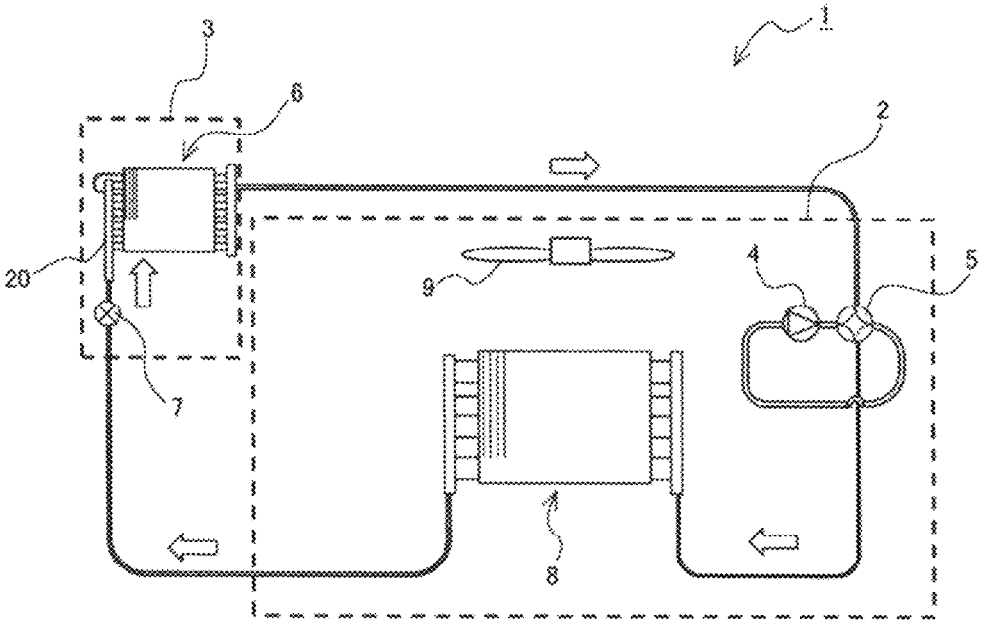
FIG. 9 is a diagram illustrating another exemplary air-conditioning apparatus according to Embodiment 1 of the present disclosure.

FIG. 9 is a diagram illustrating another exemplary air-conditioning apparatus according to Embodiment 1 of the present disclosure.

As illustrated in FIG. 9, the indoor heat exchanger 6 may include the distributor 20. This configuration improves the distribution of liquid refrigerant to individual heat exchanger tubes when the indoor heat exchanger 6 functions as an evaporator, thus making it possible to minimize an increase in the manufacturing cost of the indoor heat exchanger 6 while allowing heat exchange performance to be maintained over wide operating conditions of the air-conditioning apparatus 1 ranging from low-capacity operation to high-capacity operation.

Figure 10:
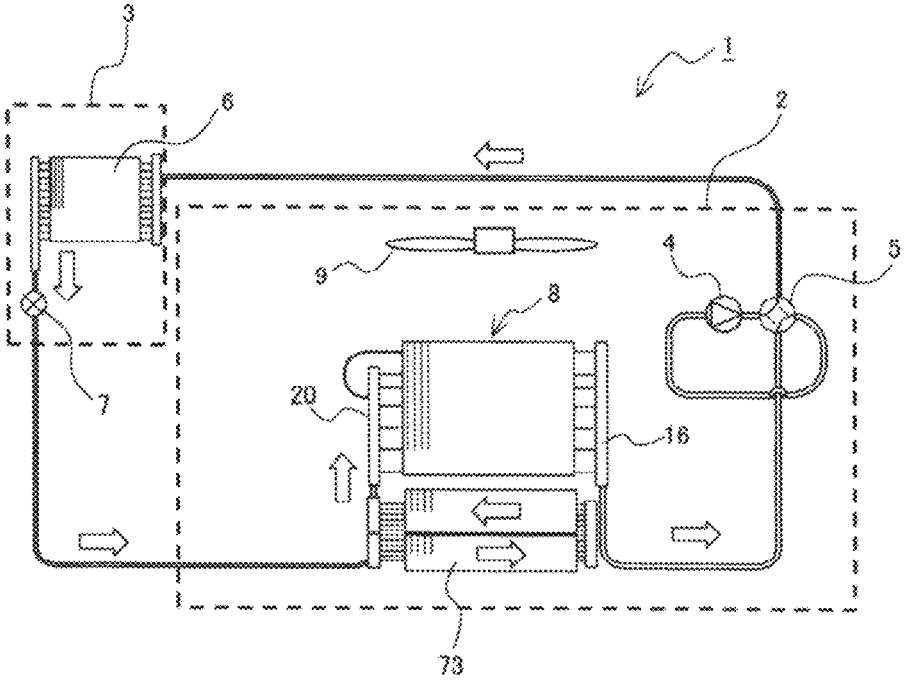
FIG. 10 is a diagram illustrating another exemplary air-conditioning apparatus according to Embodiment 1 of the present disclosure.

FIG. 10 is a diagram illustrating another exemplary air-conditioning apparatus according to Embodiment 1 of the present disclosure.

As illustrated in FIG. 10, the air-conditioning apparatus 1 may include an outdoor heat exchanger 73 disposed between the expansion device 7 and the distributor 20 of the outdoor heat exchanger 8. If the amount of heat exchange in the outdoor unit 2 is to be increased by using the outdoor heat exchanger 8 alone, the number of flow-splitting parts 50 in the distributor 20 needs to be increased to increase the number of heat transfer tubes 10. This necessitates an increase in the length of the first passage 23 of the body part 21 in the up and down direction, leading to increased pressure loss in the first passage 23. By contrast, the approach illustrated in FIG. 10, that is, connecting the outdoor heat exchanger 73 and the outdoor heat exchanger 8 in series to thereby increase the amount of heat exchange in the outdoor unit 2, does not necessitate an increase in the length of the first passage 23 of the body part 21 in the up and down direction, thus making it possible to reduce pressure loss in the first passage 23. This helps to reduce a decrease in the evaporating temperature of refrigerant flowing in the outdoor heat exchanger 8, leading to enhanced performance of the outdoor unit 2.

Figure 11:
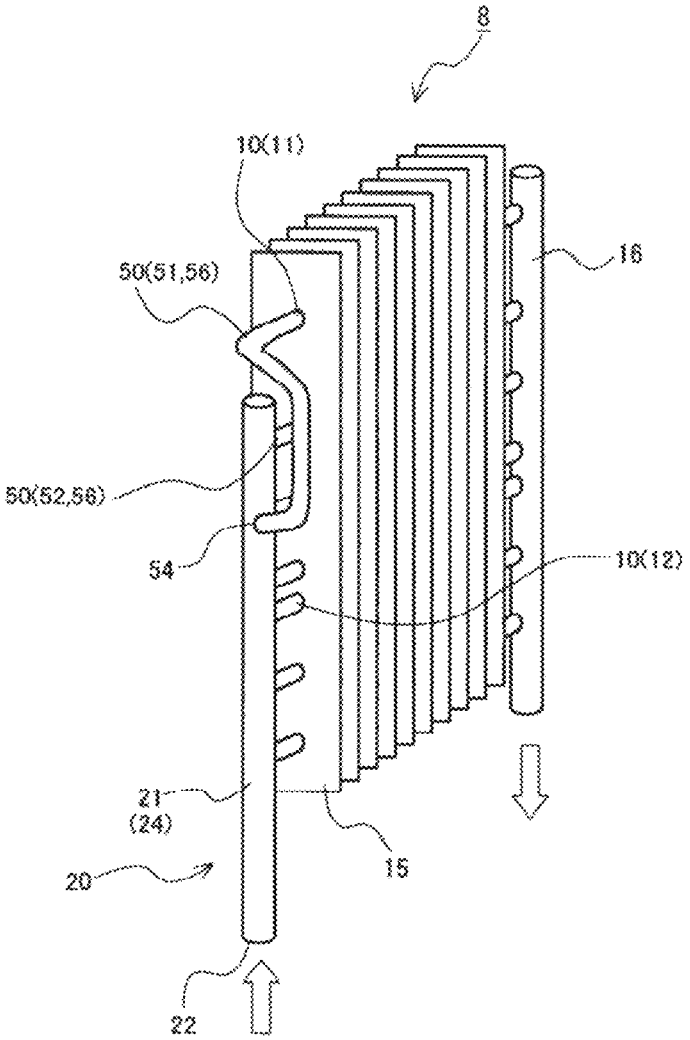
FIG. 11 is a perspective view of another exemplary outdoor heat exchanger according to Embodiment 1 of the present disclosure.

FIG. 11 is a perspective view of another exemplary outdoor heat exchanger according to Embodiment 1 of the present disclosure.

The second inlet 54 of the first flow-splitting part 51, and the first passage 23 of the body part 21 may communicate with each other at any location below the second inlet 54 of the second flow-splitting part 52 that communicates with the first passage 23 at the highest location. For example, as illustrated in FIG. 11, the second inlet 54 of the first flow-splitting part 51 may communicate with the first passage 23 of the body part 21 in a direction different from the direction in which the heat transfer tubes 10 extend, that is, the direction of arrangement of the heat transfer fins 15. Making the second inlet 54 of the first flow-splitting part 51 communicate with the first passage 23 of the body part 21 in this way makes it possible to reduce the length by which the first flow-splitting part 51 protrudes into the body part 21 in the direction of arrangement of the heat transfer fins 15. This makes it possible to reduce the length of the distributor 20 in the direction of arrangement of the heat transfer fins 15. Therefore, provided that the outdoor heat exchanger 8 illustrated in FIG. 2 and the outdoor heat exchanger 8 illustrated in FIG. 11 have the same length in the direction of arrangement of the heat transfer fins 15, the outdoor heat exchanger 8 illustrated in FIG. 11 allows for an increased length of the heat transfer tubes 10 and an increased number of heat transfer fins 15 in comparison to the outdoor heat exchanger 8 illustrated in FIG. 2. That is, in comparison to the outdoor heat exchanger 8 illustrated in FIG. 2, the outdoor heat exchanger 8 illustrated in FIG. 11 allows for increased heat transfer area and consequently enhanced heat exchange performance.

Figure 12:
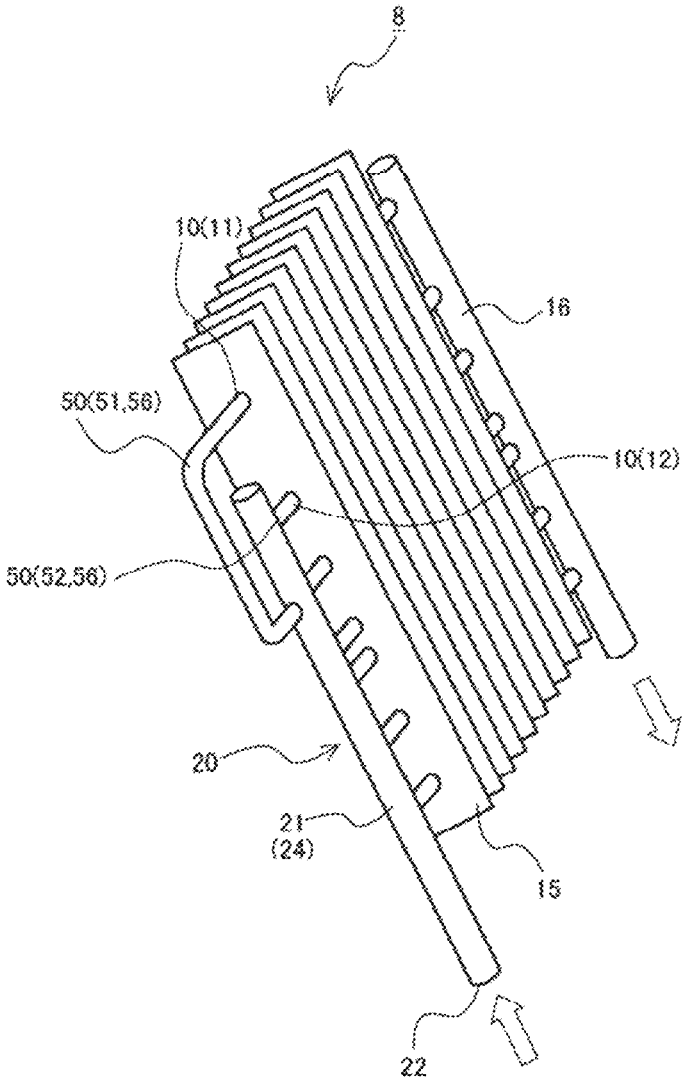
FIG. 12 is a perspective view of another exemplary outdoor heat exchanger according to Embodiment 1 of the present disclosure.

FIG. 12 is a perspective view of another exemplary outdoor heat exchanger according to Embodiment 1 of the present disclosure.

With the distributor 20 of the outdoor heat exchanger 8 described above, the direction in which the body part 21 extends, that is, the direction in which the first passage 23 extends is vertical. However, this is not intended to be limiting. As long as the direction of refrigerant flow through the first passage 23 has a vertically upward component, the direction in which the body part 21 extends, that is, the direction in which the first passage 23 extends may be inclined with respect to the vertical direction as illustrated in FIG. 12. The outdoor heat exchanger 8 can be thus placed in a tilted orientation within the outdoor unit 2. This allows for increased mounting volume and increased air passage area of the outdoor heat exchanger 8. This allows for increased heat transfer area of the outdoor heat exchanger 8 and reduced resistance to airflow through the outdoor heat exchanger 8, thus making it possible to enhance the heat exchange performance of the outdoor heat exchanger 8 and reduce required air power of the fan 9. Therefore, the power consumption of the compressor 4 and the power consumption of the fan 9 can be reduced, which leads to enhanced energy saving performance of the air-conditioning apparatus 1.

Figure 13:
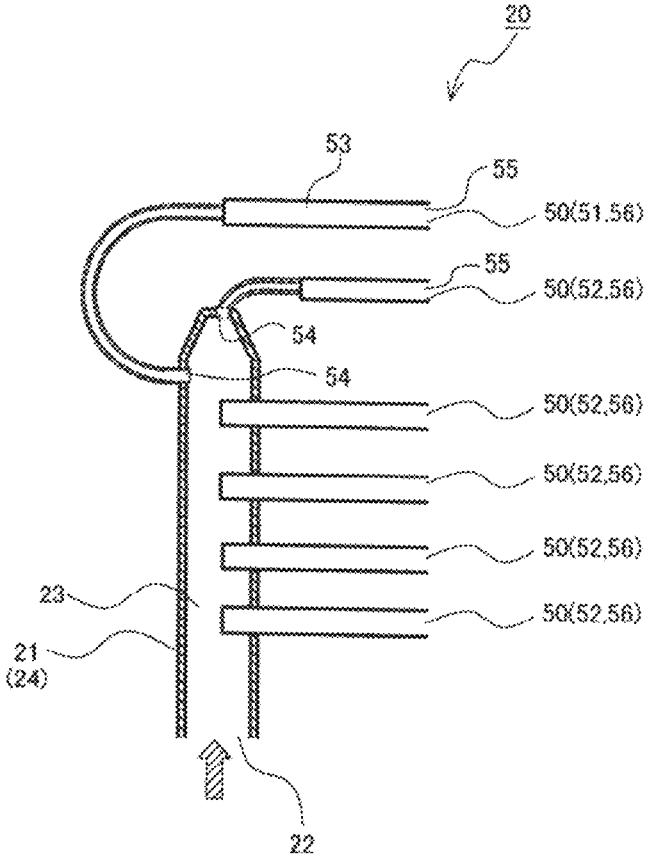
FIG. 13 is a longitudinal sectional view of an area in the vicinity of another exemplary distributor of the outdoor heat exchanger according to Embodiment 1 of the present disclosure.

FIG. 13 is a longitudinal sectional view of an area in the vicinity of another exemplary distributor of the outdoor heat exchanger according to Embodiment 1 of the present disclosure.

As illustrated in FIG. 13, one or more second flow-splitting parts 52 may be made to communicate with the first passage 23 from the top of the body part 21. This eliminates the need for a component constituting the top of the body part 21, thus making it possible to reduce the number of components constituting the distributor 20.

Figure 14:
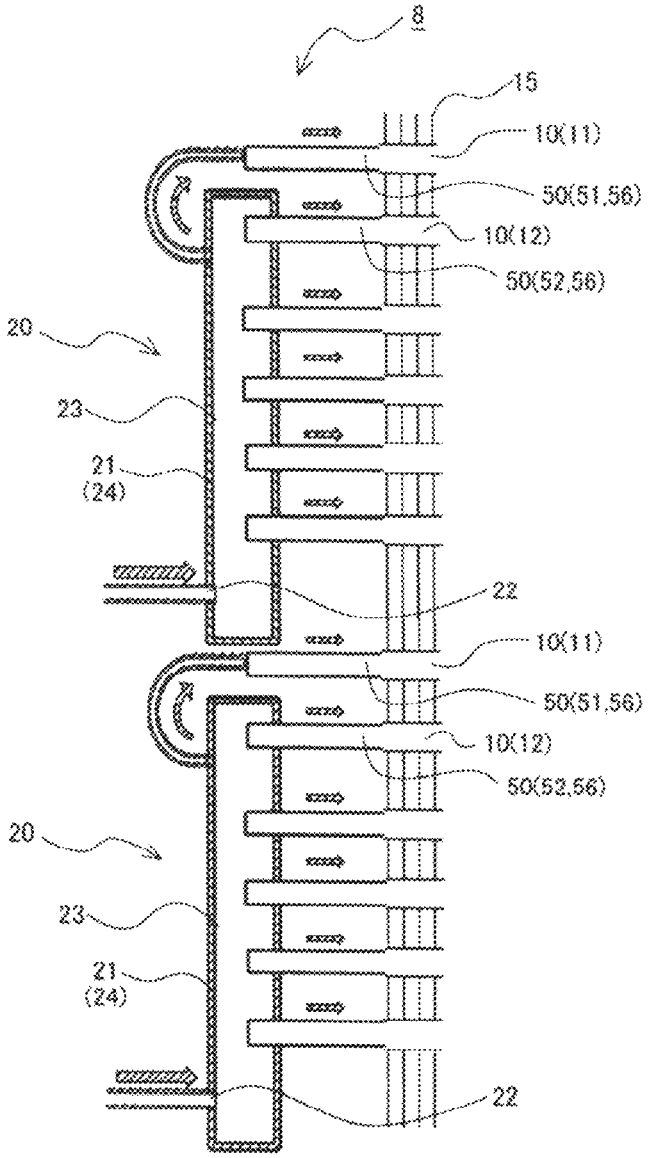
FIG. 14 is a longitudinal sectional view of an area in the vicinity of another exemplary distributor of the outdoor heat exchanger according to Embodiment 1 of the present disclosure.
Figure 15:
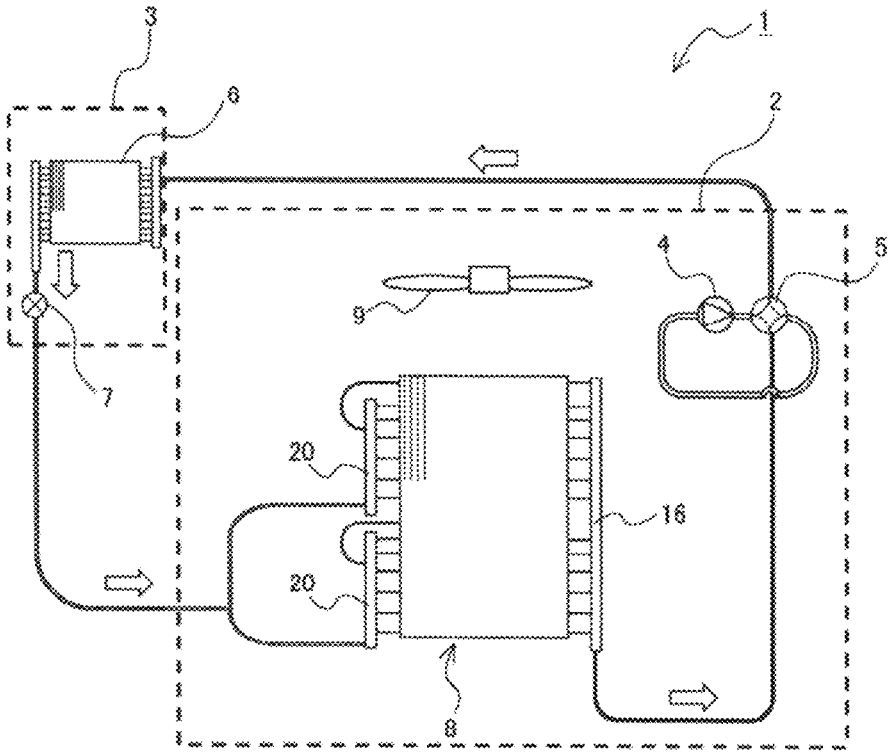
FIG. 15 is a diagram illustrating an air-conditioning apparatus including the outdoor heat exchanger illustrated in FIG. 14.

FIG. 14 is a longitudinal sectional view of an area in the vicinity of another exemplary distributor of the outdoor heat exchanger according to Embodiment 1 of the present disclosure. FIG. 15 is a diagram illustrating an air-conditioning apparatus including the outdoor heat exchanger illustrated in FIG. 14.

The first inlet 22 may not necessarily be provided at the lower end of the body part 21 but may be provided on the side of the body part 21. As a result, the refrigerant pipe connecting the expansion device 7 with the first inlet 22 does not need to be disposed below the body part 21. Depending on the configuration of the air-conditioning apparatus 1, it may be conceivable to arrange plural distributors 20 in the up and down direction, and connect the distributors 20 in parallel with the expansion device 7. For instance, in an attempt to improve the heat exchange performance of the outdoor heat exchanger 8, the number of flow-splitting parts 50 included in a single distributor 20 may be reduced to reduce imbalances in the distribution ratio of liquid distribution supplied to each individual heat transfer tube 10. In this case, it may be conceivable to arrange plural distributors 20 in the up and down direction. In arranging the distributors 20 in the up and down direction in this way, if the first inlet 22 is provided on the side of the body part 21, then adjacent distributors 20 can be disposed in proximity to each other in the up and down direction. This configuration makes it possible to reduce the required installation space for the distributors 20 in the up and down direction. This allows for high density mounting of the heat transfer tubes 10 of the outdoor heat exchanger 8, leading to enhanced heat transfer performance of the outdoor heat exchanger 8.

Embodiment 2

The following description of Embodiment 2 is directed to the location where the second inlet 54 of the first flow-splitting part 51 is preferably positioned if two or more second flow-splitting parts 52 are provided. Features not particularly described in Embodiment 2 below will be presumed to be similar to those in Embodiment 1, and functions or components identical to those in Embodiment 1 will be denoted by the same symbols.

Figure 16:
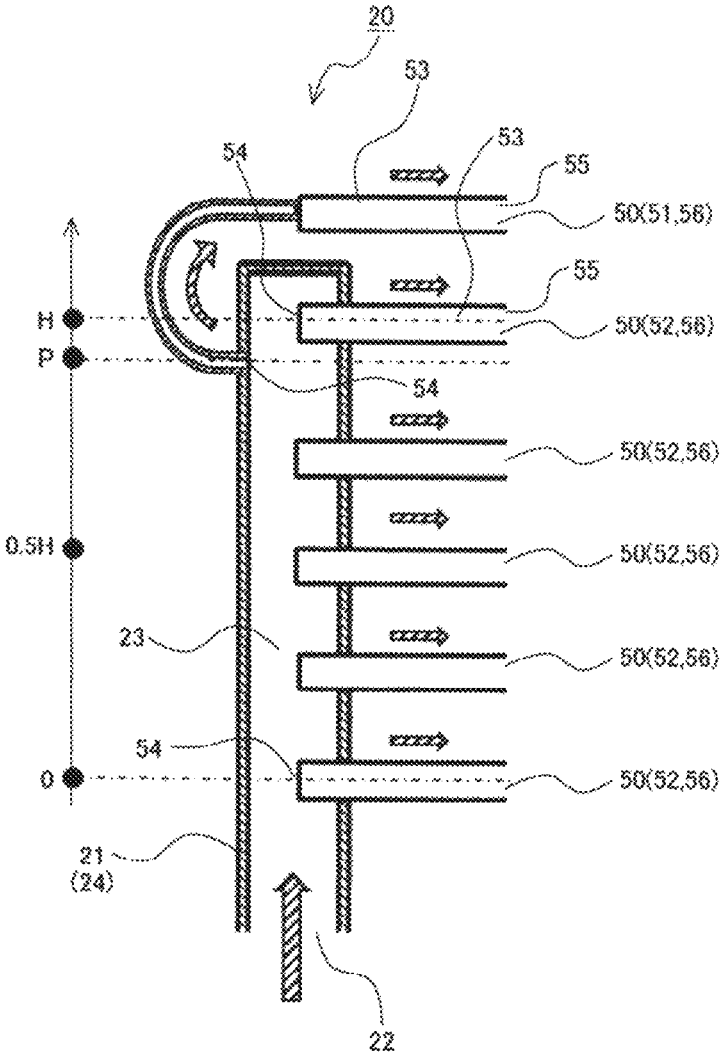
FIG. 16 is a longitudinal sectional view of an area in the vicinity of a distributor of an outdoor heat exchanger according to Embodiment 2 of the present disclosure.
Figure 17:
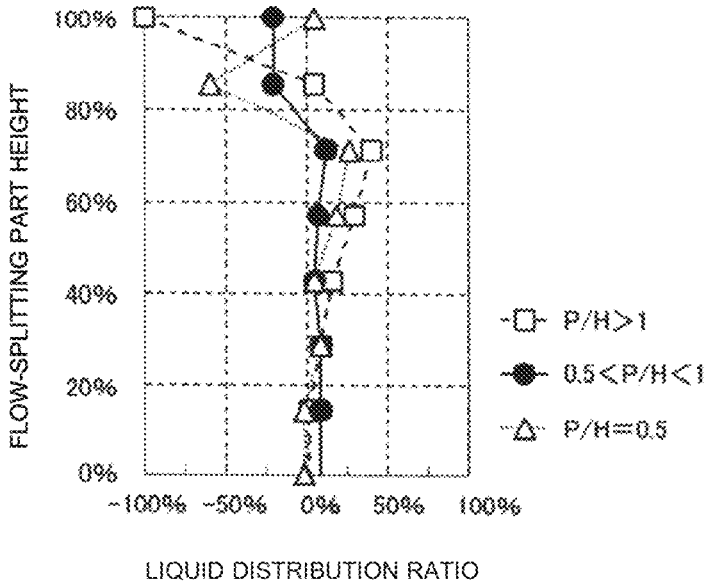
FIG. 17 illustrates the results of measurement of improvement in the distribution of liquid refrigerant in the distributor of the outdoor heat exchanger according to Embodiment 2 of the present disclosure.

FIG. 16 is a longitudinal sectional view of a distributor of an outdoor heat exchanger according to Embodiment 2 of the present disclosure. FIG. 17 illustrates the results of measurement of improvement in the distribution of liquid refrigerant in the distributor of the outdoor heat exchanger according to Embodiment 2 of the present disclosure. It is to be noted that the liquid distribution ratio taken along the horizontal axis of FIG. 17 has the same definition as the liquid distribution ratio taken along the horizontal axis of FIG. 6. The flow-splitting part height taken along the vertical axis of FIG. 17 has the same definition as the flow-splitting part height taken along the vertical axis of FIG. 6.

The distributor 20 of the outdoor heat exchanger 8 according to Embodiment 2 includes at least two second flow-splitting parts 52. Now, the second inlet 54 of the second flow-splitting part 52 whose second inlet 54 is positioned lowest is assumed to serve as a reference. In other words, the second inlet 54 of the second flow-splitting part 52 whose second inlet 54 is positioned lowest is assumed to have a height of zero. The height, from the reference, of the second inlet 54 of the second flow-splitting part 52 whose second inlet 54 is positioned highest is defined as a first height H. The height of the second inlet 54 of the first flow-splitting part 51 from the reference is defined as a second height P. With these heights defined as described above, the distributor 20 of the outdoor heat exchanger 8 according to Embodiment 2 has a height ratio P/H of greater than 0.5 and less than 1, the height ratio P/H being obtained by dividing the second height P by the first height H. That is, $0.5<P/H<1$.

The height ratio P/H is greater than 1 when the second inlet 54 of the first flow-splitting part 51 is positioned higher than the second inlet 54 of the second flow-splitting part 52 whose second inlet 54 is positioned highest. This configuration is the same as the configuration of the distributor 220 according to related art illustrated in FIG. 4. Accordingly, as represented by the open squares in FIG. 17, no liquid refrigerant is distributed to the flow-splitting part 250 with the highest positioned second inlet 54, that is, the first flow-splitting part 51. By contrast, as represented by the filled circles and the open triangles in FIG. 17, when the height ratio P/H is less than 1, liquid refrigerant can be distributed to the first flow-splitting part 51.

As can be understood from the comparison between the filled circles and the open triangles in FIG. 17, making the height ratio P/H greater than 0.5 allows more liquid refrigerant to be distributed to the second flow-splitting part 52 whose second inlet 54 is positioned highest. This is because the above-mentioned configuration helps to reduce the loss of momentum of two-phase gas-liquid refrigerant near the second inlet 54 of the second flow-splitting part 52 whose second inlet 54 is positioned highest. For the outdoor heat exchanger 8 according to Embodiment 2, the height ratio P/H is $0.5<P/H<1$ as described above. This helps to further reduce imbalances in the distribution ratio of liquid refrigerant supplied to the individual heat transfer tubes 10, leading to enhanced heat exchange performance.

Embodiment 3

The following description of Embodiment 3 is directed to an exemplary configuration of the first flow-splitting part 51 for a case in which two or more first heat transfer tubes 11 are provided. Features not particularly described in Embodiment 3 below will be presumed to be similar to those in Embodiment 1 or 2, and functions or components identical to those in Embodiment 1 or 2 will be denoted by the same symbols.

Figure 18:
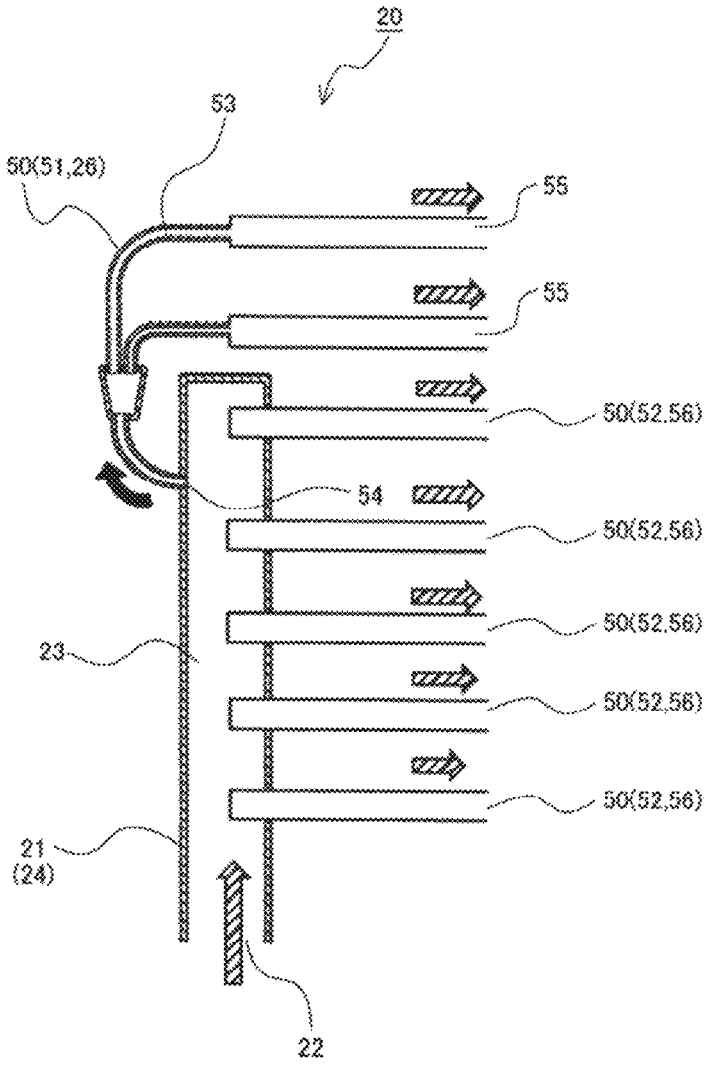
FIG. 18 is a longitudinal sectional view of an area in the vicinity of a distributor of an outdoor heat exchanger according to Embodiment 3 of the present disclosure.

FIG. 18 is a longitudinal sectional view of an area in the vicinity of a distributor of an outdoor heat exchanger according to Embodiment 3 of the present disclosure.

The outdoor heat exchanger 8 according to Embodiment 3 includes at least two first heat transfer tubes 11. FIG. 18 depicts an example of the outdoor heat exchanger 8 including two first heat transfer tubes 11. At least one first flow-splitting part 51 of the distributor 20 of the outdoor heat exchanger 8 according to Embodiment 3 communicates with at least two first heat transfer tubes 11. More specifically, the first flow-splitting part 51 has one second inlet 54 and at least two outlets 55. Each outlet 55 communicates with a different first heat transfer tube 11. In Embodiment 3, a branch pipe 26 constituting the first flow-splitting part 51, the branch pipe 26 being split in an end portion near the first heat transfer tube 11 into plural passages.

The above-mentioned configuration of the outdoor heat exchanger 8 makes it possible to reduce the number of locations where the second inlet 54 of each flow-splitting part 50 communicates with the first passage 23 of the body part 21. This helps to reduce disturbances in the flow of refrigerant within the first passage 23, thus reducing dissipation of the kinetic energy of refrigerant within the first passage 23. This allows more liquid refrigerant to be distributed to higher positioned heat transfer tubes 10, leading to enhanced heat exchange performance of the outdoor heat exchanger 8.

Embodiment 4

The distributor 20 may be of any configuration as long as the second inlet 54 of the first flow-splitting part 51 and the second inlet 54 of the second flow-splitting part 52 have the positional relationship described above. The following description of Embodiment 4 will be directed to a specific exemplary configuration of the distributor 20. Features not particularly described in Embodiment 4 below will be presumed to be similar to those in Embodiments 1 to 3, and functions or components identical to those in Embodiments 1 to 3 will be denoted by the same symbols.

Figure 19:
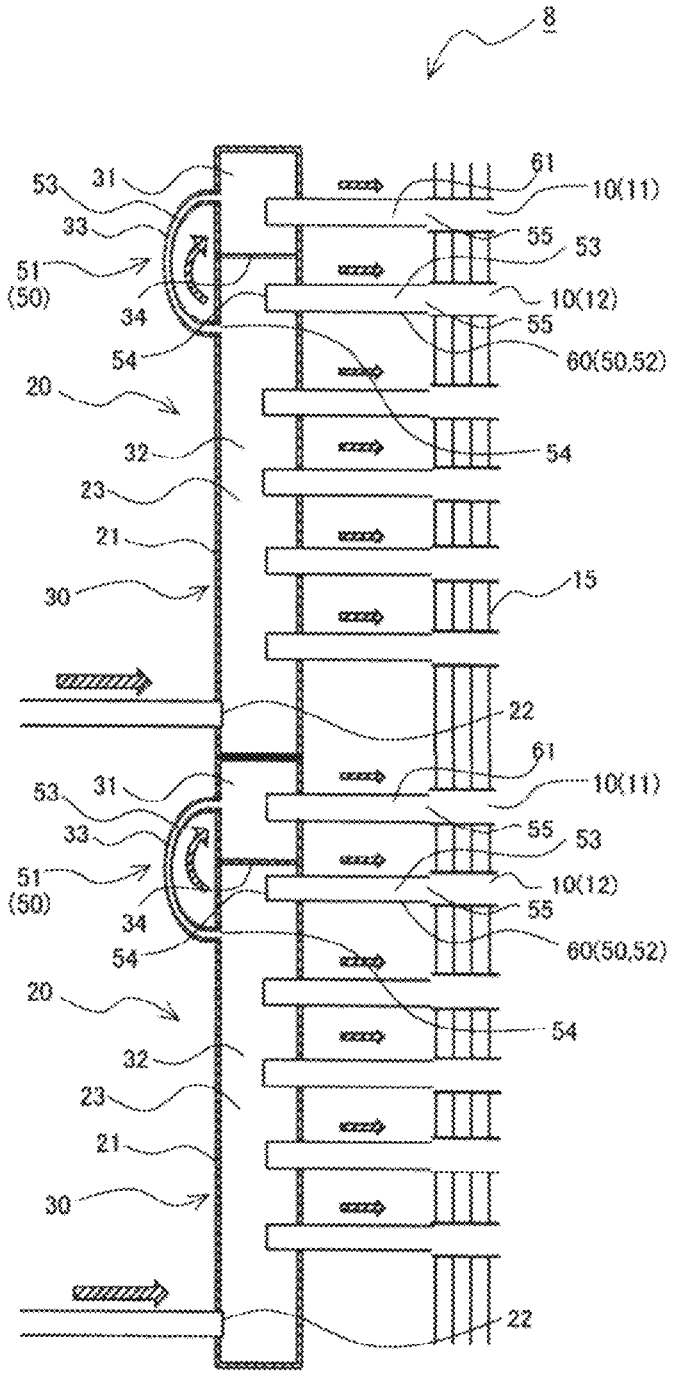
FIG. 19 is a longitudinal sectional view of an area in the vicinity of a distributor of an outdoor heat exchanger according to Embodiment 4 of the present disclosure.
Figure 20:
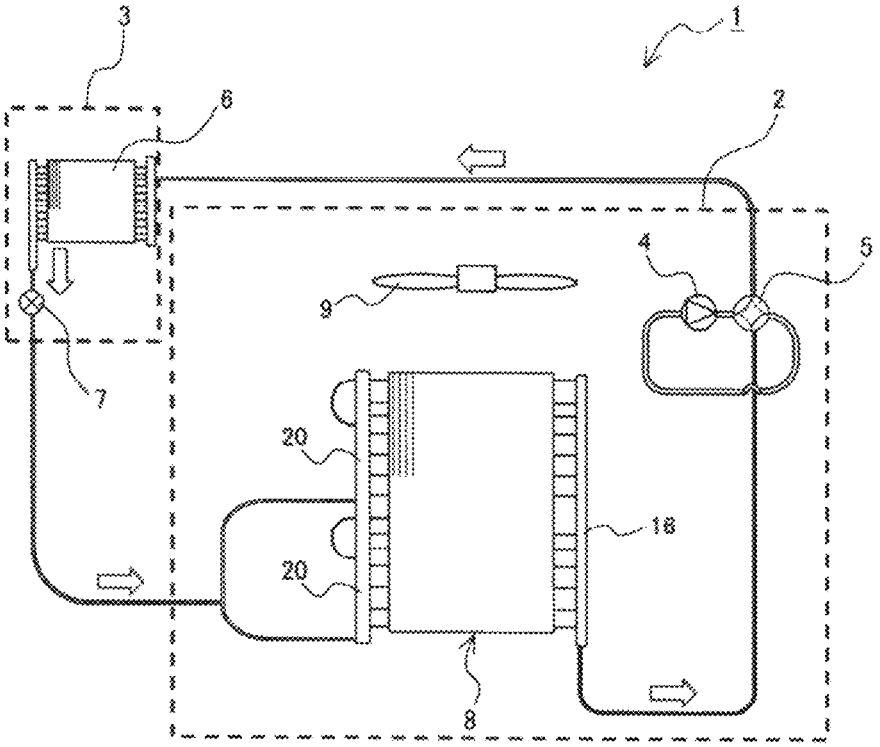
FIG. 20 is a diagram illustrating an air-conditioning apparatus including the outdoor heat exchanger illustrated in FIG. 19.

FIG. 19 is a longitudinal sectional view of an area in the vicinity of a distributor of an outdoor heat exchanger according to Embodiment 4 of the present disclosure. FIG. 20 is a diagram of an air-conditioning apparatus including the outdoor heat exchanger illustrated in FIG. 19.

The distributor 20 according to Embodiment 4 includes a third tubular component 30. The interior of the third tubular component 30 is divided by a partition wall 34 into an upper space 31 and a lower space 32. The distributor 20 also includes a communication part 33 that provides communication between the upper space 31 and the lower space 32, at least one fourth tubular component 60 that provides communication between the lower space 32 and one of the second heat transfer tubes 12, and at least one fifth tubular component 61 that provides communication between the upper space 31 and one of the first heat transfer tubes 11. In Embodiment 4, the communication part 33 is formed as a tubular component.

In the distributor 20 configured as described above, the area in the third tubular component 30 where the lower space 32 is located serves as the body part 21. The lower space 32 serves as the first passage 23. The fourth tubular component 60 serves as the second flow-splitting part 52. The communication part 33, the area in the third tubular component 30 where the upper space 31 is located, and the fifth tubular component 61 serve as the first flow-splitting part 51. That is, the location where the communication part 33 communicates with the lower space 32 serves as the second inlet 54 of the first flow-splitting part 51.

The above-mentioned configuration of the distributor 20 makes it possible to reduce the required installation space for the distributor 20 in the up and down direction, in comparison to forming the first flow-splitting part 51 solely by the second tubular component 56. As described above, there are cases in which plural distributors 20 are arranged in the up and down direction. The above-mentioned configuration of the distributor 20 according to Embodiment 4 allows for high density mounting of the heat transfer tubes 10 of the outdoor heat exchanger 8, leading to enhanced heat transfer performance of the outdoor heat exchanger 8. In Embodiment 4, the third tubular components 30 of the distributors 20 that are adjacent to each other in the up and down direction are formed integrally with each other. In other words, the interior of a single tubular component is divided into two third tubular components 30.

Embodiment 5

The communication part 33 described above with reference to Embodiment 4 may not necessarily be a tubular component. Alternatively, the communication part 33 may be formed as described below with reference to Embodiment 5. Features not particularly described in Embodiment 5 below will be assumed to be similar to those in Embodiment 4, and functions or components identical to those in Embodiment 4 will be denoted by the same symbols.

Figure 21:
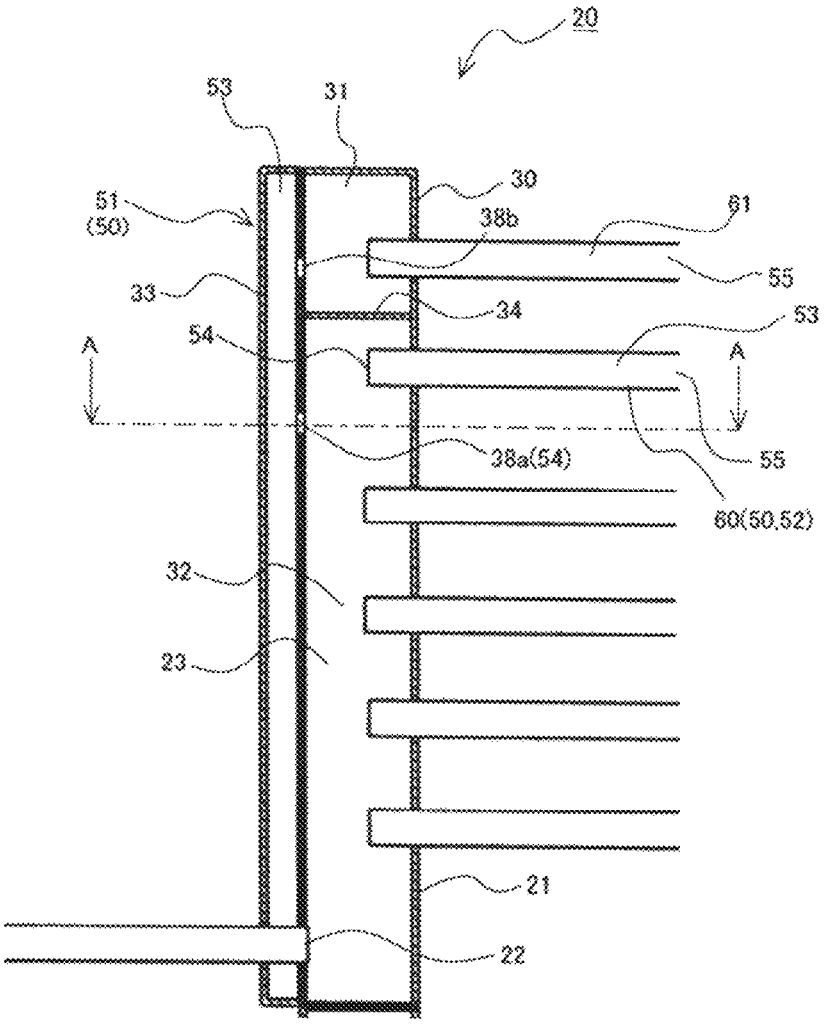
FIG. 21 is a longitudinal sectional view of an area in the vicinity of a distributor of an outdoor heat exchanger according to Embodiment 5 of the present disclosure.
Figure 22:
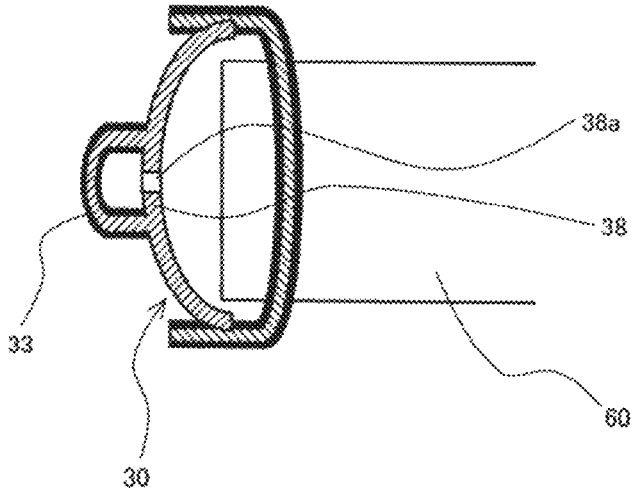
FIG. 22 is a sectional view taken along A-A in FIG. 21.

FIG. 21 is a longitudinal sectional view of an area in the vicinity of a distributor of an outdoor heat exchanger according to Embodiment 5 of the present disclosure. FIG. 22 is a sectional view taken along A-A in FIG. 21.

In the distributor 20 according to Embodiment 5, the third tubular component 30 and the communication part 33 are formed integrally with each other. More specifically, the third tubular component 30 is formed by joining together two components that are U-shaped in section such that these components face each other. Beside one of the components with a U-shaped section constituting the third tubular component 30, a tubular part constituting the communication part 33 is formed integrally with this component. A wall 38 divides the third tubular component 30 and the communication part 33 from each other. The wall 38 includes a through-hole 38*a*, which provides communication between the interior of the communication part 33 and the lower space 32 within the third tubular component 30, and a through-hole 38*b*, which provides communication between the interior of the communication part 33 and the upper space 31 within the third tubular component 30. That is, the through-hole 38*a* serves as the second inlet 54 of the first flow-splitting part 51.

As compared with the configuration of the distributor 20 illustrated in FIG. 4, the above-mentioned configuration of the distributor 20 according to Embodiment 5 makes it possible to reduce the number of components constituting the distributor 20, thus simplifying the structure of the distributor 20.

Embodiment 6

The distributor 20 may have various configurations as long as the second inlet 54 of the first flow-splitting part 51 and the second inlet 54 of the second flow-splitting part 52 have the positional relationship described above. Accordingly, the distributor may have the configuration as described below with reference to Embodiment 6. Features not particularly described in Embodiment 6 below will be assumed to be similar to those in Embodiments 1 to 5, and functions or components identical to those in Embodiments 1 to 5 will be denoted by the same symbols.

Figure 23:
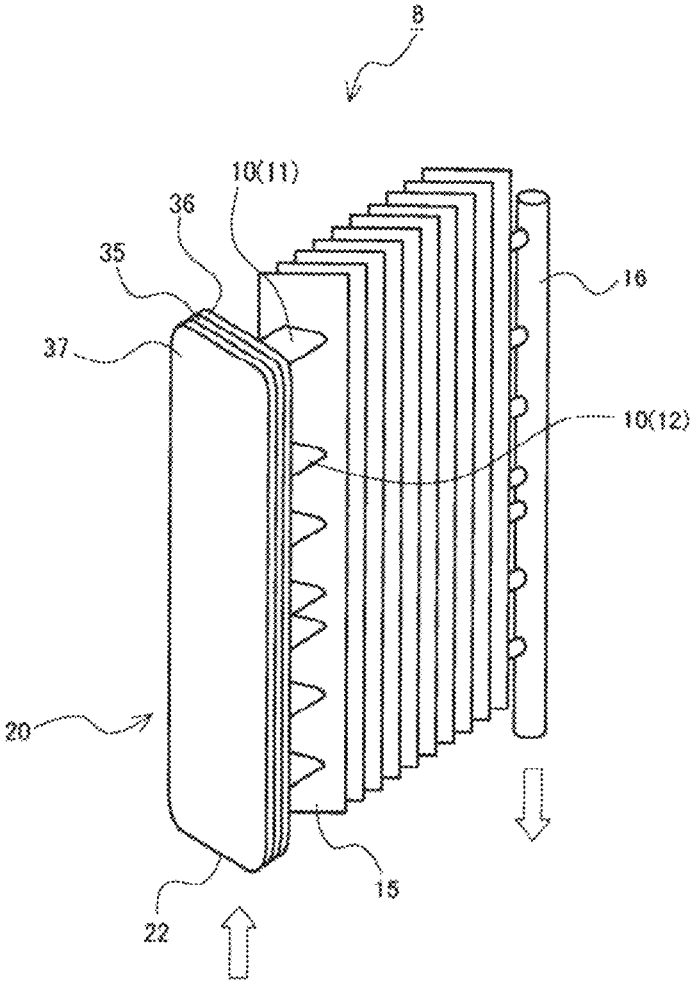
FIG. 23 is a perspective view of an outdoor heat exchanger according to Embodiment 6 of the present disclosure.
Figure 24:
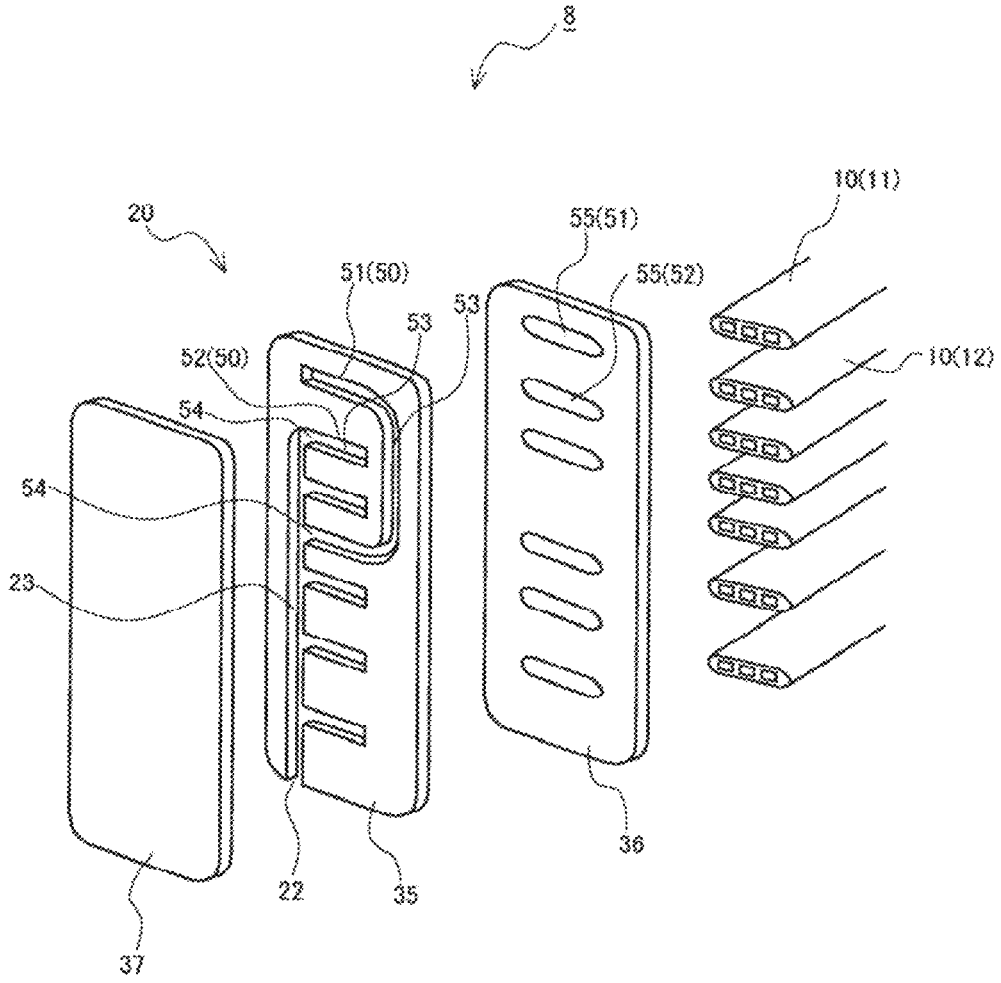
FIG. 24 is an exploded perspective view of an area in the vicinity of a distributor of the outdoor heat exchanger according to Embodiment 6 of the present disclosure.
Figure 25:
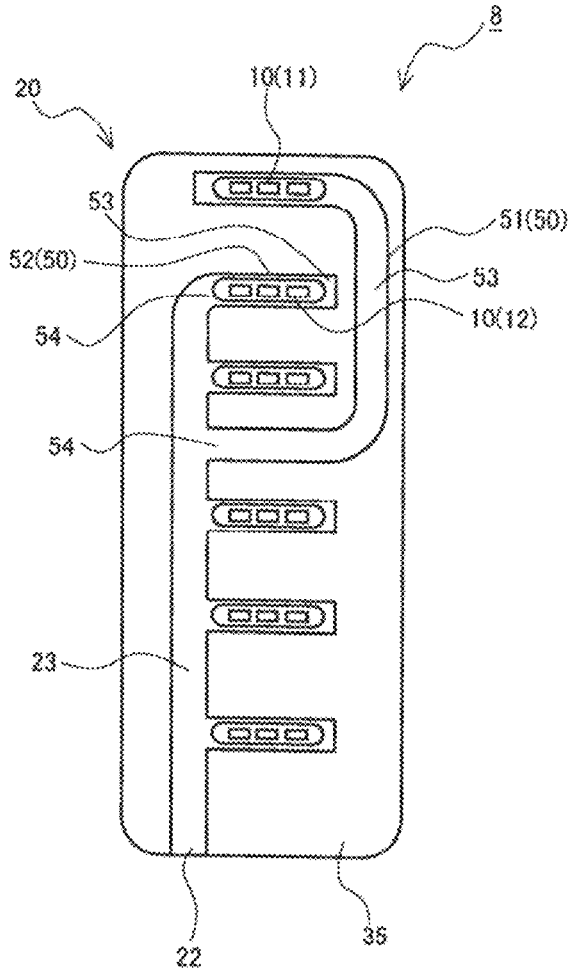
FIG. 25 is a side view of the outdoor heat exchanger according to Embodiment 6 of the present disclosure, illustrating the outdoor heat exchanger with a third plate-like component of the distributor removed.

FIG. 23 is a perspective view of an outdoor heat exchanger according to Embodiment 6 of the present disclosure. FIG. 24 is an exploded perspective view of an area in the vicinity of a distributor of the outdoor heat exchanger according to Embodiment 6 of the present disclosure. FIG. 25 is a side view of the outdoor heat exchanger according to Embodiment 6 of the present disclosure, illustrating the outdoor heat exchanger with a third plate-like component of the distributor removed.

The distributor 20 according to Embodiment 6 includes a first plate-like component 35, a second plate-like component 36 disposed on one side of the first plate-like component 35, and a third plate-like component 37 disposed on the other side of the first plate-like component 35. The third plate-like component 37, the first plate-like component 35, and the second plate-like component 36 are stacked in this order to form the distributor 20.

More specifically, the first plate-like component 35 includes the following elements: the first inlet 22; the first passage 23; the second inlet 54 of the second flow-splitting part 52; the second passage 53 of the second flow-splitting part 52; the second inlet 54 of the first flow-splitting part 51; and the second passage 53 of the first flow-splitting part 51. The second plate-like component 36 includes the following elements: the outlet 55 of the second flow-splitting part 52 that communicates with the second inlet 54 of the second flow-splitting part 52; and the outlet 55 of the first flow-splitting part 51 that communicates with the second inlet 54 of the first flow-splitting part 51. The second heat transfer tube 12 communicates with the outlet 55 of the second flow-splitting part 52 provided in the second plate-like component 36. The first heat transfer tube 11 communicates with the outlet 55 of the first flow-splitting part 51 provided in the second plate-like component 36. The third plate-like component 37 blocks the respective lateral openings of the following elements: the first inlet 22; the first passage 23; the second inlet 54 of the second flow-splitting part 52; the second passage 53 of the second flow-splitting part 52; the second inlet 54 of the first flow-splitting part 51; and the second passage 53 of the first flow-splitting part 51. Embodiment 6 employs, as the first heat transfer tube 11 and the second heat transfer tube 12, flat heat transfer tubes each including plural passages defined therein.

The above-mentioned configuration of the distributor 20 allows the first passage 23 and the second passage 53 to be reduced in effective cross-sectional area in comparison to forming the distributor 20 by use of a tubular component. The configuration of the distributor 20 according to Embodiment 6 thus makes it possible to increase the velocity of two-phase gas-liquid refrigerant travelling upward in the first passage 23, thus allowing liquid refrigerant to reach a higher height. Further, the configuration of the distributor 20 according to Embodiment 6 makes it possible to reduce the amount of refrigerant within the distributor 20. This helps to ensure that, even if the amount of refrigerant charged into the refrigeration cycle circuit of the air-conditioning apparatus 1 is reduced for reasons such as safety or environmental regulations, degradation of the heat exchange performance of the outdoor heat exchanger 8 can be reduced.

Figure 26:
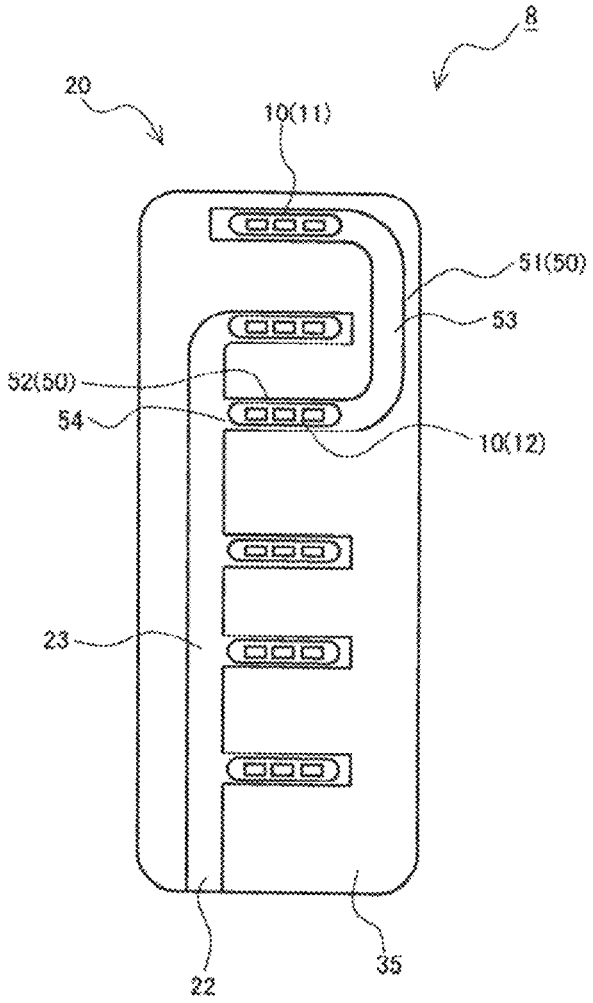
FIG. 26 is a side view of another exemplary outdoor heat exchanger according to Embodiment 6 of the present disclosure, illustrating the outdoor heat exchanger with the third plate-like component of the distributor removed.

FIG. 26 is a side view of another exemplary outdoor heat exchanger according to Embodiment 6 of the present disclosure, illustrating the outdoor heat exchanger with the third plate-like component of the distributor removed.

As illustrated in FIG. 26, the second passage 53 of the second flow-splitting part 52, and the second passage 53 of the first flow-splitting part 51 may be connected with each other such that the same second inlet 54 serves as both the second inlet 54 of the second flow-splitting part 52 and the second inlet 54 of the first flow-splitting part 51.

The first plate-like component 35 and the third plate-like component 37 may be formed integrally with each other by, for example, half-blanking performed on a single plate-like component. This allows for reduced number of components constituting the distributor 20, thus making it possible to simplify the structure of the distributor 20.

Embodiment 7

The following description of Embodiment 7 will be directed to an exemplary distributor 20 suited for use in an evaporator in which air velocity is greater at higher locations than at lower locations. Features not particularly described in Embodiment 7 below will be presumed to be similar to those in Embodiments 1 to 6, and functions or components identical to those in Embodiments 1 to 6 will be denoted by the same symbols.

Figure 27:
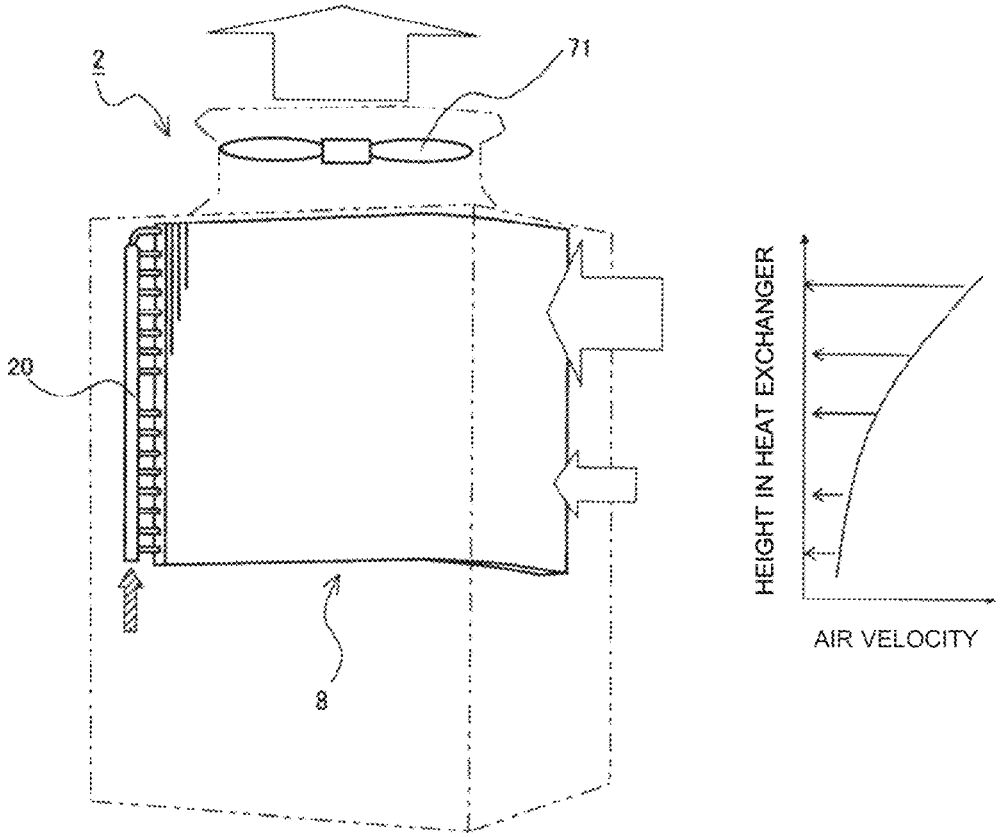
FIG. 27 is a perspective view of an outdoor unit of an air-conditioning apparatus according to Embodiment 7 of the present disclosure.
Figure 28:
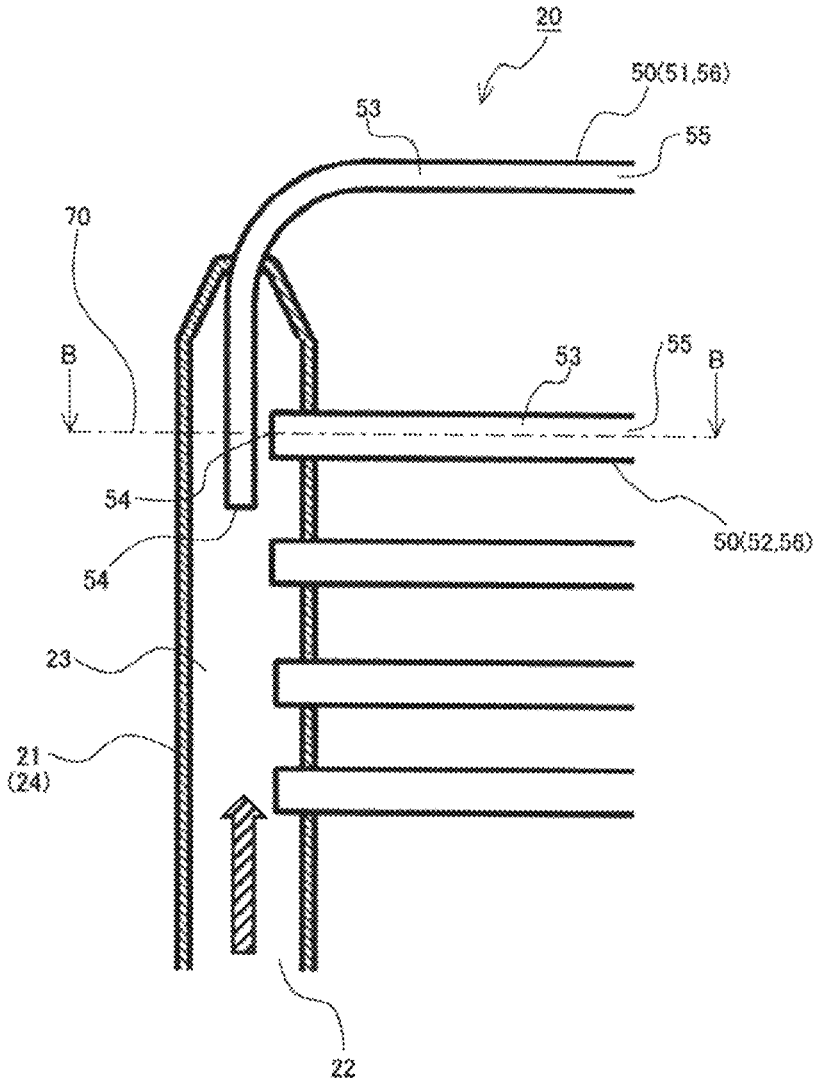
FIG. 28 is a longitudinal sectional view of an area in the vicinity of a distributor of an outdoor heat exchanger according to Embodiment 7 of the present disclosure.
Figure 29:
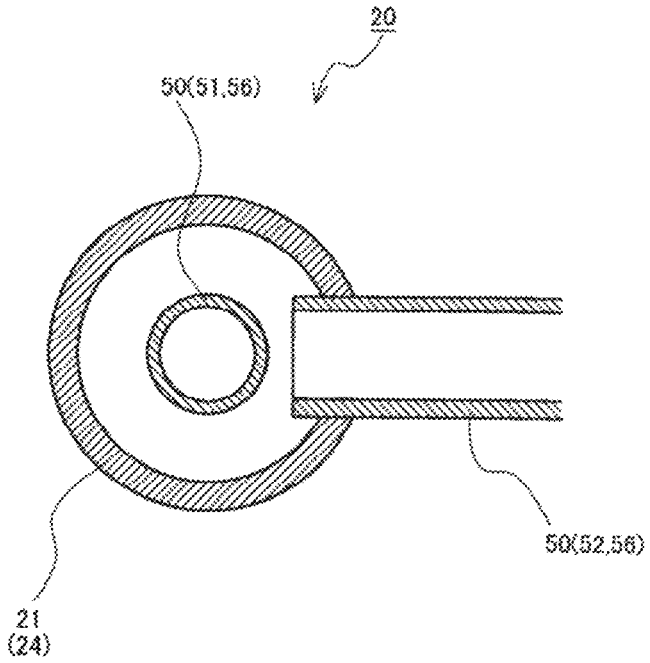
FIG. 29 is a sectional view taken along B-B in FIG. 28.
Figure 30:
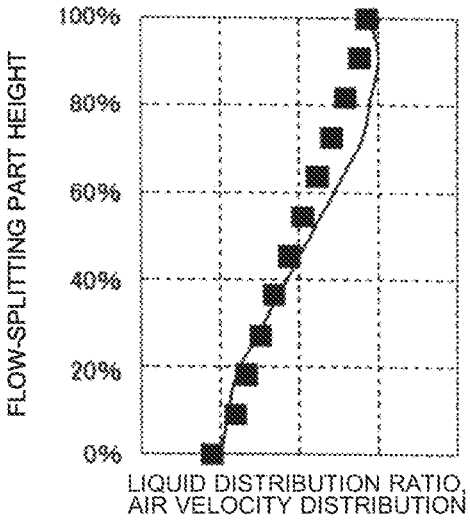
FIG. 30 illustrates, for the outdoor heat exchanger according to Embodiment 7 of the present disclosure, the distribution ratios of liquid refrigerant among individual flow-splitting parts, and air velocities near the individual flow-splitting parts.

FIG. 27 is a perspective view of an outdoor unit of an air-conditioning apparatus according to Embodiment 7 of the present disclosure. FIG. 28 is a longitudinal sectional view of an area in the vicinity of a distributor of an outdoor heat exchanger according to Embodiment 7 of the present disclosure. FIG. 29 is a sectional view taken along B-B in FIG. 28. FIG. 30 illustrates, for the outdoor heat exchanger according to Embodiment 7 of the present disclosure, the distribution ratios of liquid refrigerant among individual flow-splitting parts, and air velocities near the individual flow-splitting parts. In FIG. 27, the housing of the outdoor unit 2 is represented by imaginary lines for easy viewing of the interior of the outdoor unit 2. FIG. 27 also illustrates the relationship between height position in the outdoor heat exchanger 8, and air velocity. The open arrows in FIG. 27 represent the flow of air, with larger arrows indicating greater air velocity. In FIG. 30, the solid line represents air velocity, which increases toward the right-hand side of FIG. 30. In FIG. 30, the filled squares each represent liquid distribution ratio representative of the ratio of liquid refrigerant, with the amount of liquid refrigerant supplied increasing toward the right-hand side of FIG. 30.

The outdoor unit 2 according to Embodiment 7 includes an axial fan 71 disposed above the outdoor heat exchanger 8. The axial fan 71 blows out air upward from the axial fan 71. That is, the outdoor unit 2 according to Embodiment 7 is of a top-blowing type. For the outdoor unit 2 of this type, with regard to the air velocity in the outdoor heat exchanger 8, the air velocity increases gradually from a lower portion of the outdoor heat exchanger 8 toward an upper portion as illustrated in FIGS. 27 and 30. That is, with regard to the airflow rate in the outdoor heat exchanger 8, the airflow rate increases gradually from a lower portion of the outdoor heat exchanger 8 toward an upper portion.

When the outdoor heat exchanger 8 described above functions as an evaporator, it is necessary to ensure that higher positioned heat transfer tubes 10 receive more liquid refrigerant. To ensure that higher positioned heat transfer tubes 10 receive more liquid refrigerant, the effective cross-sectional area of the first passage 23 of the distributor 20 may be decreased uniformly in the up and down direction. This approach, however, leads to increased pressure loss in the first passage 23 in comparison to the pressure loss in each heat transfer tube 10. This results in lower positioned heat transfer tubes 10 receiving more liquid refrigerant than higher positioned heat transfer tubes 10. That is, with the above-mentioned approach, it is not possible to distribute liquid refrigerant to the individual heat transfer tubes 10 in accordance with air velocity distribution. This leads to degradation of the heat exchange performance of the outdoor heat exchanger 8.

Accordingly, Embodiment 7 employs the distributor 20 as illustrated in FIGS. 28 and 29. More specifically, an end portion defining the second inlet 54 of the second tubular component 56 serving as the first flow-splitting part 51 is inserted into the first passage 23 from an upper end of the first tubular component 24, which serves as the body part 21. In this regard, among virtual planes that pass through the second inlet 54 of the second tubular component 56 serving as the second flow-splitting part 52 and are perpendicular to the direction of flow of two-phase gas-liquid refrigerant in the first passage 23, the virtual plane located above the second inlet 54 of the first flow-splitting part 51 is defined as a first plane 70. With the first plane 70 defined as described above, the second tubular component 56 serving as the first flow-splitting part 51 extends through the first plane 70.

With the distributor 20 configured as described above, the first passage 23 does not decrease in effective cross-sectional area at locations below the second inlet 54 of the first flow-splitting part 51, and decreases in cross-sectional area at locations above the second inlet 54 of the first flow-splitting part 51. This allows for reduced pressure loss in the first passage 23 at locations below the second inlet 54 of the first flow-splitting part 51. Further, at locations above the second inlet 54 of the first flow-splitting part 51, two-phase gas-liquid refrigerant can be increased in flow velocity. This makes it possible to distribute liquid refrigerant to the individual heat transfer tubes 10 in accordance with air velocity distribution, leading to enhanced heat exchange performance of the outdoor heat exchanger 8.

In some cases, the indoor unit 3 may be of a top-flow type with an axial fan disposed above the indoor heat exchanger 6. For the indoor unit 3 of this type, with regard to the airflow rate in the indoor heat exchanger 6, the airflow rate increases gradually from a lower portion of the indoor heat exchanger 6 toward an upper portion as with the air velocity distribution illustrated in each of FIGS. 27 and 30. Accordingly, for the indoor unit 3 of a top-flow type, it may be preferable to use the distributor 20 according to Embodiment 7 as the distributor of the indoor heat exchanger 6. It may be also preferable to, when the indoor heat exchanger 6 functions as an evaporator, distribute liquid refrigerant to individual heat transfer tubes by use of the distributor 20. This makes it possible to distribute liquid refrigerant to individual heat transfer tubes in accordance with air velocity distribution, leading to enhanced heat exchange performance of the indoor heat exchanger 6.

Figure 31:
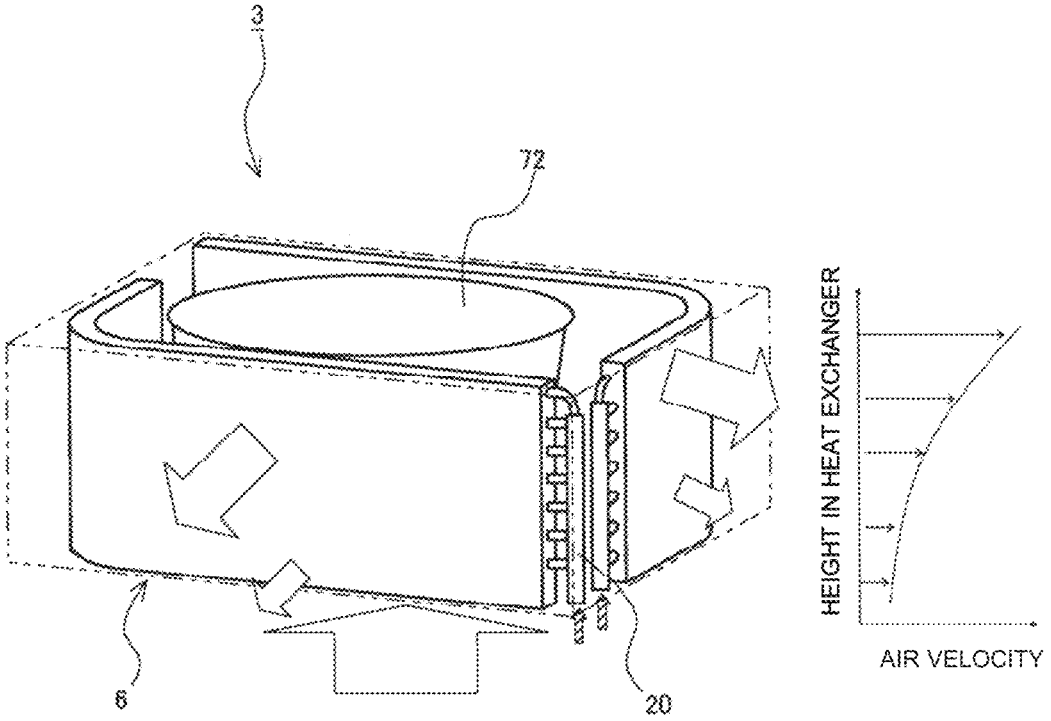
FIG. 31 is a perspective view of another exemplary indoor unit of the air-conditioning apparatus according to Embodiment 7 of the present disclosure.

FIG. 31 is a perspective view of another exemplary indoor unit of an air-conditioning apparatus according to Embodiment 7 of the present disclosure. In FIG. 31, the housing of the indoor unit 3 is represented by imaginary lines for easy viewing of the interior of the indoor unit 3. FIG. 31 also illustrates the relationship between height position in the indoor heat exchanger 6, and air velocity. The open arrows in FIG. 31 represent the flow of air, with larger arrows indicating greater air velocity.

The indoor unit 3 in FIG. 31 includes a centrifugal fan 72 disposed beside the indoor heat exchanger 6. The centrifugal fan 72 sucks air from below, and blows out the sucked air toward the indoor heat exchanger 6 disposed beside the centrifugal fan 72. That is, the indoor unit 3 in FIG. 31 is of a side-flow type. The indoor heat exchanger 6 includes the distributor 20 according to Embodiment 7, and is configured to, when functioning as an evaporator, distribute liquid refrigerant to individual heat transfer tubes by use of the distributor 20.

For the indoor unit 3 of this type, the airflow rate in the indoor heat exchanger 6 increases gradually from a lower portion of the indoor heat exchanger 6 toward an upper portion as illustrated in FIG. 31. Therefore, using the distributor 20 according to Embodiment 7 as the distributor of the indoor heat exchanger 6 makes it possible to, when the indoor heat exchanger 6 functions as an evaporator, distribute liquid refrigerant in accordance with air velocity distribution, thus allowing for enhanced heat exchange performance of the indoor heat exchanger 6.

In some cases, the outdoor unit 2 may be of a side-flow type with a centrifugal fan disposed beside the outdoor heat exchanger 8. For the outdoor unit 2 of this type, the airflow rate in the outdoor heat exchanger 8 increases gradually from a lower portion of the outdoor heat exchanger 8 toward an upper portion as with the air velocity distribution illustrated in FIG. 31. Accordingly, for the outdoor unit 2 of a side-blowing type, it may be preferable to use the distributor 20 according to Embodiment 7 as the distributor of the outdoor heat exchanger 8. It may be also preferable to, when the outdoor heat exchanger 8 functions as an evaporator, distribute liquid refrigerant to the individual heat transfer tubes 10 by use of the distributor 20. This makes it possible to distribute liquid refrigerant to the individual heat transfer tubes 10 in accordance with air velocity distribution, leading to enhanced heat exchange performance of the outdoor heat exchanger 8.

Embodiment 8

For an evaporator that exchanges heat with air blown out laterally by an axial fan, it may be conceivable to distribute liquid refrigerant to individual heat transfer tubes by use of two distributors 20 disposed in the up and down direction. In such a case, each distributor 20 may be preferably configured as described below with reference to Embodiment 8. Features not particularly described in Embodiment 8 below will be presumed to be similar to those in Embodiments 1 to 7, and functions or components identical to those in Embodiments 1 to 7 will be denoted by the same symbols.

Figure 32:
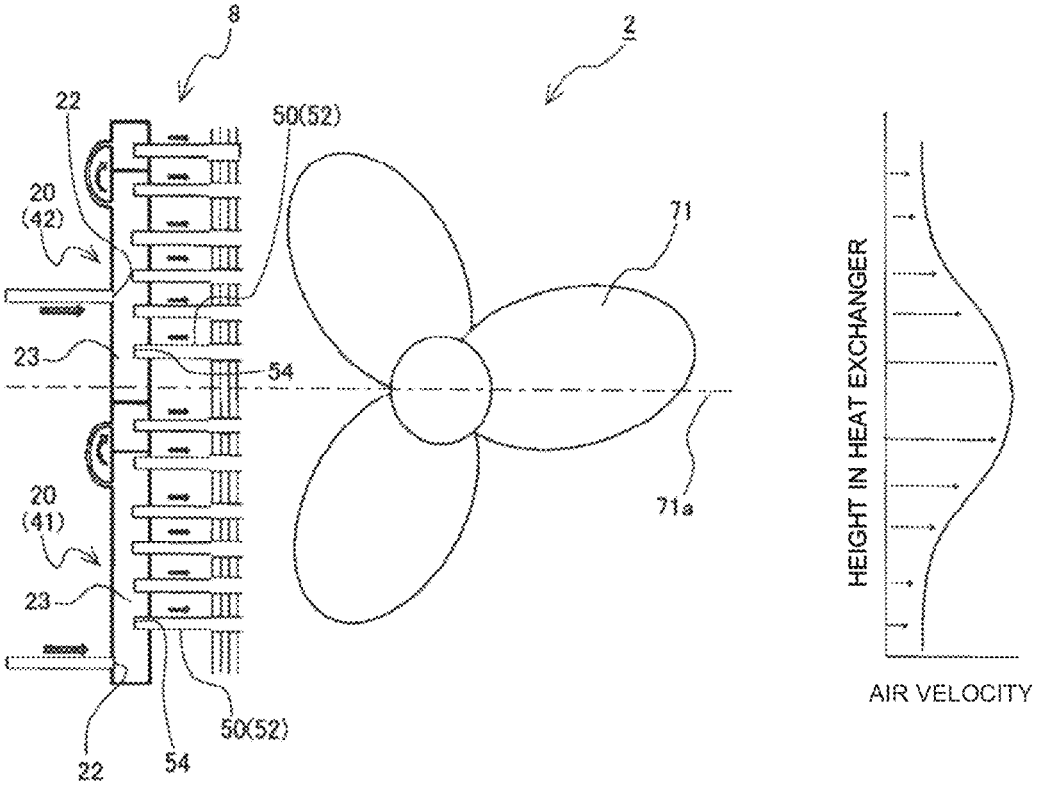
FIG. 32 illustrates an outdoor unit of an air-conditioning apparatus according to Embodiment 8 of the present disclosure.
Figure 33:
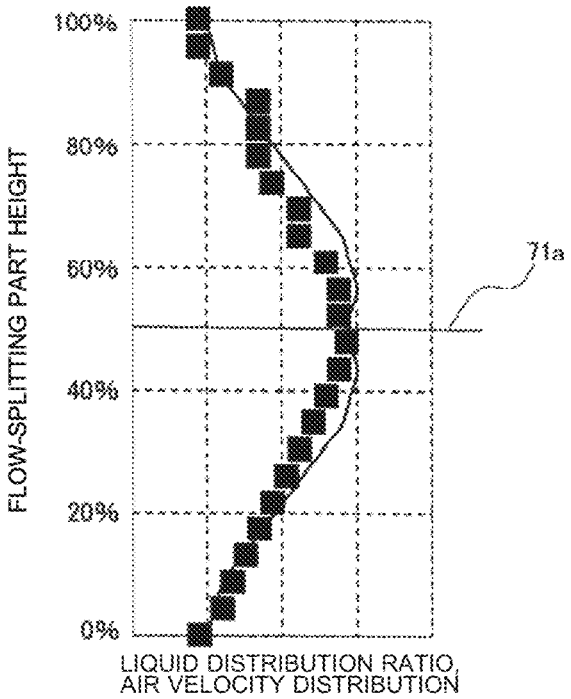
FIG. 33 illustrates, for an outdoor heat exchanger according to Embodiment 8 of the present disclosure, the distribution ratios of liquid refrigerant among individual flow-splitting parts, and air velocities near the individual flow-splitting parts.

FIG. 32 illustrates an outdoor unit of an air-conditioning apparatus according to Embodiment 8 of the present disclosure. FIG. 33 illustrates, for an outdoor heat exchanger according to Embodiment 8 of the present disclosure, the distribution ratios of liquid refrigerant among individual flow-splitting parts, and air velocities near the individual flow-splitting parts. FIG. 32 also illustrates the relationship between height position in the outdoor heat exchanger 8, and air velocity. In FIG. 33, the solid line represents air velocity, which increases toward the right-hand side of FIG. 33. In FIG. 33, the filled squares each represent liquid distribution ratio representative of the ratio of liquid refrigerant, with the amount of liquid refrigerant supplied increasing toward the right-hand side of FIG. 33.

The outdoor unit 2 according to Embodiment 8 includes the axial fan 71 that blows out air laterally. That is, the axial fan 71 has a rotation axis 71*a* that extends in the lateral direction. Beside the axial fan 71, the outdoor heat exchanger 8 is disposed upstream or downstream of the axial fan 71 with respect to the direction of airflow. The outdoor heat exchanger 8 includes separate distributors 20, one disposed below the rotation axis 71*a* of the axial fan 71 and one disposed above the rotation axis 71*a* of the axial fan 71. The distributor 20 disposed below the rotation axis 71*a* of the axial fan 71 will hereinafter be referred to as distributor 41. The distributor 20 disposed above the rotation axis 71*a* of the axial fan 71 will be referred to as distributor 42.

For the distributor 41 disposed below the rotation axis 71*a* of the axial fan 71, the second inlets 54 of all of the flow-splitting parts 50 communicate with the first passage 23 at a location above the first inlet 22. For the distributor 42 disposed above the rotation axis 71*a* of the axial fan 71, the second inlets 54 of one or more flow-splitting parts 50 communicate with the first passage 23 at a location below the first inlet 22.

For the outdoor unit 2 configured as described above, with regard to the air velocity in the outdoor heat exchanger 8, the air velocity increases at a location near the rotation axis 71*a* as illustrated in FIG. 32. That is, with regard to the airflow rate in the outdoor heat exchanger 8, the airflow rate increases at a location near the rotation axis 71*a*. When the outdoor heat exchanger 8 described above functions as an evaporator, it is necessary to ensure that the heat transfer tubes 10 located closer to the rotation axis 71*a* receive more liquid refrigerant.

Accordingly, as described above, for the distributor 41 disposed below the rotation axis 71*a* of the axial fan 71, the second inlets 54 of all of the flow-splitting parts 50 communicate with the first passage 23 at a location above the first inlet 22. This configuration of the distributor 41 ensures that all of the two-phase gas-liquid refrigerant entering the first passage 23 through the first inlet 22 flows upward in the first passage 23. As a result, in the distributor 41, more liquid refrigerant can be supplied to the flow-splitting parts 50 that communicate with the first passage 23 at a higher location. That is, more liquid refrigerant can be supplied to the heat transfer tubes 10 positioned near the rotation axis 71*a*.

As described above, for the distributor 42 disposed above the rotation axis 71*a* of the axial fan 71, the second inlets 54 of one or more flow-splitting parts 50 communicate with the first passage 23 at a location below the first inlet 22. This configuration of the distributor 42 ensures that a portion of the two-phase gas-liquid refrigerant entering the first passage 23 through the first inlet 22 flows upward in the first passage 23, and another portion of the two-phase gas-liquid refrigerant flows downward in the first passage 23. At this time, gravity causes a large portion of the two-phase gas-liquid refrigerant to flow downward in the first passage 23. As a result, in the distributor 42, more liquid refrigerant can be supplied to the flow-splitting parts 50 that communicate with the first passage 23 at a location below the first inlet 22. That is, more liquid refrigerant can be supplied to the heat transfer tubes 10 positioned near the rotation axis 71*a*. As for the flow-splitting part 50 whose second inlet 54 communicates with the first passage 23 at a location above the first inlet 22, the distance between the first inlet 22 and the second inlet 54 is short. This ensures that the amount of liquid refrigerant supplied to the flow-splitting part 50 mentioned above does not decrease significantly.

As described above, for the outdoor heat exchanger 8 with air supplied laterally from the axial fan 71, the presence of the distributors 41 and 42 described above helps to ensure that when the outdoor heat exchanger 8 functions as an evaporator, liquid refrigerant can be distributed to the individual heat transfer tubes 10 in accordance with air velocity distribution. This allows for enhanced heat exchange performance of the outdoor heat exchanger 8.

Figure 34:
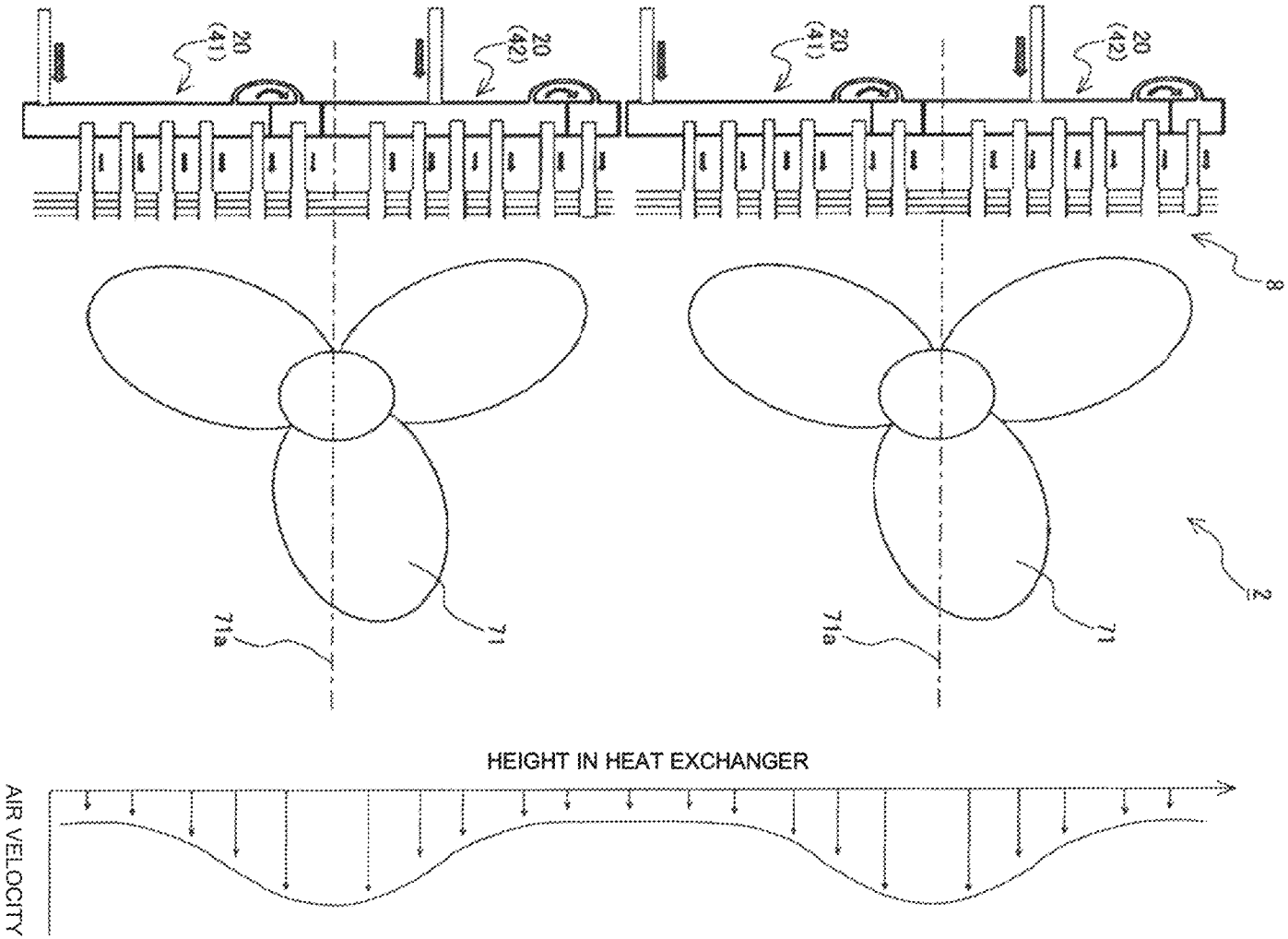
FIG. 34 illustrates another exemplary outdoor unit of the air-conditioning apparatus according to Embodiment 8 of the present disclosure.

FIG. 34 illustrates another exemplary outdoor unit of an air-conditioning apparatus according to Embodiment 8 of the present disclosure. FIG. 34 also illustrates the relationship between height position in the outdoor heat exchanger 8, and air velocity.

If plural axial fans 71 that blow out air laterally are disposed in the up and down direction, then for each axial fan 71, the distributor 41 and the distributor 42 may be positioned with reference to the rotation axis 71*a*. This helps to ensure that when the outdoor heat exchanger 8 functions as an evaporator, liquid refrigerant can be distributed to the individual heat transfer tubes 10 in accordance with air velocity distribution, thus allowing for enhanced heat exchange performance of the outdoor heat exchanger 8.

There also exist indoor units 3 in which heat is exchanged between air supplied from an axial fan that blows out air laterally, and the indoor heat exchanger 6. In this case, it may be preferable for the indoor heat exchanger 6 to include the distributor 41 and the distributor 42. This helps to ensure that when the indoor heat exchanger 6 functions as an evaporator, liquid refrigerant can be distributed to individual heat transfer tubes in accordance with air velocity distribution, thus allowing for enhanced heat exchange performance of the indoor heat exchanger 6.

REFERENCE SIGNS LIST

1 air-conditioning apparatus 2 outdoor unit 3 indoor unit 4 compressor 5 four-way valve 6 indoor heat exchanger 7 expansion device 8 outdoor heat exchanger 9 fan 10 heat transfer tube 11 first heat transfer tube 12 second heat transfer tube 15 heat transfer fin 16 flow-combining pipe 20 distributor 21 body part 22 first inlet 23 first passage 24 first tubular component 26 branch pipe 30 third tubular component 31 upper space 32 lower space 33 communication part 34 partition wall 35 first plate-like component 36 second plate-like component 37 third plate-like component 38 wall 38*a* through-hole 38*b* through-hole 41 distributor 42 distributor 50 flow-splitting part 51 first flow-splitting part 52 second flow-splitting part 53 second passage 54 second inlet 55 outlet 56 second tubular component 60 fourth tubular component 61 fifth tubular component 70 first plane 71 axial fan 71*a* rotation axis 72 centrifugal fan 73 outdoor heat exchanger 100 liquid refrigerant 101 gas refrigerant 102 liquid reach height 220 distributor (related art) 221 body part (related art) 222 inlet (related art) 223 passage (related art) 250 flow-splitting part (related art) 253 passage 254 inlet (related art) 255 outlet (related art).

The invention claimed is:

1. A heat exchanger comprising:

a plurality of heat transfer tubes, the heat transfer tubes being disposed with a predetermined spacing from each other in an up and down direction; and a distributor configured to distribute refrigerant to the plurality of the heat transfer tubes, wherein the distributor includes a body part including a first inlet for refrigerant, and a first passage in which refrigerant entering through the first inlet flows upward, and a plurality of flow-splitting parts having second inlets located at different heights in the first passage, each flow-splitting part including a second passage and communicating at one of the second inlets with the first passage and communicating at an outlet with one of the heat transfer tubes to conduct the refrigerant from the one of the second inlets to the one of the heat transfer tubes, and wherein the second inlets of at least two of the flow-splitting parts each communicate with the first passage at a location above the first inlet, wherein among the heat transfer tubes each communicating with the outlet of the flow-splitting part of which the second inlet communicates with the first passage at a location above the first inlet, at least a first one of the heat transfer tubes from top is defined as a first heat transfer tube, wherein among the heat transfer tubes each communicating with the outlet of the flow-splitting part of which the second inlet communicates with the first passage at a location above the first inlet, the heat transfer tube positioned below the first heat transfer tube is defined as a second heat transfer tube, wherein the flow-splitting part of which the outlet communicates with the first heat transfer tube is defined as a first flow-splitting part, wherein the flow-splitting part of which the outlet communicates with the second heat transfer tube is defined as a second flow-splitting part, and wherein the second inlet of the first flow-splitting part communicates with the first passage at a location below the second inlet of the second flow-splitting part that communicates with the first passage at a highest location.

2. The heat exchanger of claim 1, wherein the body part is a first tubular component, the first tubular component including the first passage defined inside the first tubular component, and wherein each flow-splitting part is a second tubular component, the second tubular component including the second passage defined inside the second tubular component.

3. The heat exchanger of claim 2, wherein an end portion defining the second inlet of the second tubular component protrudes into the first tubular component from a side of the first tubular component, and wherein the end portion of the second tubular component serving as the first flow-splitting part protrudes into the first tubular component by a length shorter than a length by which the end portion of the second tubular component serving as the second flow-splitting part protrudes into the first tubular component.

4. The heat exchanger of claim 2, wherein an end portion defining the second inlet of the second tubular component serving as the second flow-splitting part protrudes into the first tubular component from a side of the first tubular component, and wherein the end portion of the second tubular component serving as the first flow-splitting part does not protrude into the first tubular component.

5. The heat exchanger of claim 2, wherein an end portion defining the second inlet of the second tubular component serving as the first flow-splitting part is inserted into the first tubular component from an upper end of the first tubular component, wherein among a plurality of virtual planes that pass through the second inlet of the second tubular component serving as the second flow-splitting part and are perpendicular to a direction of flow of refrigerant in the first passage, a virtual plane located above the second inlet of the first flow-splitting part is defined as a first plane, and wherein the second tubular component serving as the first flow-splitting part extends through the first plane.

6. The heat exchanger of claim 1, wherein the distributor includes a third tubular component having an interior divided into an upper space and a lower space, a communication part configured to provide communication between the upper space and the lower space, at least one fourth tubular component configured to provide communication between the lower space and one of the second heat transfer tubes, and at least one fifth tubular component configured to provide communication between the upper space and one of the first heat transfer tubes, wherein an area in the third tubular component where the lower space is provided serves as the body part, wherein the lower space serves as the first passage, wherein the fourth tubular component serves as the second flow-splitting part, wherein the communication part, an area in the third tubular component where the upper space is provided, and the fifth tubular component serve as the first flow-splitting part, and wherein a location where the communication part communicates with the lower space serves as the second inlet of the first flow-splitting part.

7. The heat exchanger of claim 6, wherein the third tubular component and the communication part are formed integrally with each other.

8. The heat exchanger of claim 1, wherein the first heat transfer tube comprises at least two first heat transfer tubes, and wherein the first flow-splitting part comprises at least one first flow-splitting part, the second inlet of the at least one first flow-splitting parts comprises one second inlet, the outlet of the at least one first flow-splitting part comprises at least two outlets, and the at least one first flow-splitting part communicates with the at least two first heat transfer tubes.

9. The heat exchanger of claim 1, wherein as viewed in section taken perpendicular to a direction of flow of refrigerant in the first passage, refrigerant entering the second inlet of the first flow-splitting part flows in a direction different from a direction of flow of refrigerant entering the second inlet of the second flow-splitting part.

10. The heat exchanger of claim 1, wherein the distributor includes a first plate-like component including the first inlet, the first passage, the second inlet of the second flow-splitting part, the second passage of the second flow-splitting part, the second inlet of the first flow-splitting part, and the second passage of the first flow-splitting part, a second plate-like component disposed on one side of the first plate-like component, the second plate-like component including the outlet of the second flow-splitting part that communicates with the second inlet of the second flow-splitting part, and the outlet of the first flow-splitting part that communicates with the second inlet of the first flow-splitting part, and a third plate-like component disposed on an other side of the first plate-like component, and wherein the third plate-like component, the first plate-like component, and the second plate-like component are stacked on each other to form the distributor.

11. The heat exchanger of claim 1, wherein the second flow-splitting part of the distributor comprises at least two second flow-splitting parts, wherein the second inlet of the second flow-splitting part of which the second inlet is positioned lowest is defined as a reference, wherein a height, from the reference, of the second inlet of the second flow-splitting part of which the second inlet is positioned highest is defined as a first height, wherein a height of the second inlet of the first flow-splitting part from the reference is defined as a second height, and wherein a height ratio obtained by dividing the second height by the first height is greater than 0.5 and less than 1.

12. An air-conditioning apparatus comprising:

the heat exchanger of claim 1 that functions as an evaporator; and a fan that supplies air to the heat exchanger.

13. An air-conditioning apparatus comprising:

the heat exchanger of claim 5 that functions as an evaporator; and a fan that supplies air to the heat exchanger;

wherein the fan is an axial fan or a centrifugal fan, the axial fan being disposed above the heat exchanger to blow out air upward from the axial fan, the centrifugal fan being disposed beside the heat exchanger.

14. The air-conditioning apparatus of claim 12, wherein the fan is an axial fan that blows out air laterally, wherein the distributor of the heat exchanger comprises separate distributors, the separate distributors including a distributor positioned below a rotation axis of the axial fan, and a distributor positioned above the rotation axis, wherein for the distributor positioned below the rotation axis, the second inlets of all of the flow-splitting parts communicate with the first passage at a location above the first inlet, and wherein for the distributor positioned above the rotation axis, the second inlets of one or more of the flow-splitting parts communicate with the first passage at a location below the first inlet.

15. The heat exchanger of claim 2, wherein the second tubular component being the first flow-splitting part has a shape such that the refrigerant in the second passage rises from the height of the second inlet and bends horizontally after rising.

16. The heat exchanger of claim 15, wherein the second tubular component being the second flow-splitting part extending horizontally from the height of the second inlet.

* * * * *